US011139565B2

(12) United States Patent
Jeon et al.

(10) Patent No.: US 11,139,565 B2
(45) Date of Patent: Oct. 5, 2021

(54) ELECTRONIC DEVICE INCLUDING STRUCTURE FOR SECURING COVERAGE OF ANTENNA

(71) Applicant: SAMSUNG ELECTRONICS CO., LTD., Suwon-si (KR)

(72) Inventors: Seunggil Jeon, Suwon-si (KR); Namwoo Kim, Suwon-si (KR); Seongbeom Hong, Suwon-si (KR); Sunghoon Moon, Suwon-si (KR); Kyungwoo Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/913,110

(22) Filed: Jun. 26, 2020

(65) Prior Publication Data

US 2020/0411978 A1 Dec. 31, 2020

(30) Foreign Application Priority Data

Jun. 28, 2019 (KR) ..... 10-2019-0078183

(51) Int. Cl.
*H01Q 1/42* (2006.01)
*H01Q 1/24* (2006.01)

(52) U.S. Cl.
CPC ..... *H01Q 1/421* (2013.01); *H01Q 1/241* (2013.01)

(58) Field of Classification Search
CPC ..... H01Q 1/24; H01Q 1/241; H01Q 1/243; H01Q 1/421; H01Q 9/0407; H01Q 15/08;
(Continued)

(56) References Cited

U.S. PATENT DOCUMENTS 9,237,211 B2 1/2016 Tabe
2017/0373376 A1 12/2017 Jo et al.
(Continued)

FOREIGN PATENT DOCUMENTS

CN 209017097 6/2019

OTHER PUBLICATIONS

International Search Report and Written Opinion dated Oct. 16, 2020 in corresponding International Application No. PCT/KR2020/008352.

*Primary Examiner* — Hoang V Nguyen
(74) *Attorney, Agent, or Firm* — Nixon & Vanderhye, P.C.

(57) ABSTRACT

An electronic device is disclosed. An electronic device according to various embodiments includes: a housing having a front plate facing a first direction, a rear plate facing a second direction opposite the first direction, and a side housing surrounding a space between the front plate and the rear plate; a conductive member comprising a conductive material disposed between the front plate and the rear plate; a display viewable through the front plate; at least one antenna module including a plurality of antenna elements configured to form a beam in a third direction facing the conductive member, and disposed to be spaced apart from the conductive member in the space; and a wireless communication circuit electrically coupled to the antenna module and configured to transmit and/or receive at least one signal having a frequency in a range of 3 GHz to 100 GHz, wherein the conductive member has a first surface forming a first acute angle with a virtual line crossing centers of the antenna elements and facing in the third direction, and a second surface forming a second acute angle with the virtual line, wherein a joint of the first surface and the second surface is positioned on the virtual line.

20 Claims, 20 Drawing Sheets

(58) Field of Classification Search
CPC ..... H01Q 15/18; H01Q 15/23; H01Q 19/06; H01Q 19/106; H01Q 21/08; H01Q 25/005
See application file for complete search history.

(56) References Cited

U.S. PATENT DOCUMENTS

| | | | | |
|---|---|---|---|---|
| 2018/0151947 | A1 | 5/2018 | Apostolos et al. | |
| 2018/0241115 | A1 | 8/2018 | Cho et al. | |
| 2019/0165454 | A1 | 5/2019 | Lee et al. | |
| 2019/0165470 | A1* | 5/2019 | Jeon ..... | H01Q 21/0006 |

* cited by examiner

ELECTRONIC DEVICE INCLUDING STRUCTURE FOR SECURING COVERAGE OF ANTENNA

CROSS-REFERENCE TO RELATED APPLICATION

This application is based on and claims priority under 35 U.S.C. § 119 to Korean Patent Application No. 10-2019-0078183, filed on Jun. 28, 2019, in the Korean Intellectual Property Office, the disclosure of which is incorporated by reference herein in its entirety.

BACKGROUND

1) Field

The disclosure relates to an electronic device including a structure for securing a coverage of an antenna.

2) Description of Related Art

According to various embodiments, electronic devices may include a 5G terminal antenna radiating millimeter waves (mmWave) for users of the electronic device to transmit/receive high-quality contents. As communication devices are developed, electronic devices may include an antenna module that can transmit fast large data to produce and transmit 3D contents, connect with various objects through the internet (e.g., Internet Of Things (IoT)), or connect communication between various sensors for autonomous driving.

The characteristic and the beam shape of an antenna module that radiates millimeter waves (mmWave) may be changed in accordance with the shape and material of a housing and the arrangement of the antenna module due to straightness and transmission loss.

When an antenna module having a millimeter wave (mmWave) characteristic is mounted in a housing, antenna radiation efficiency may be reduced by the shape of a housing, or electronic parts and conductive members that are disposed in an electronic device.

The above information is presented as background information only to assist with an understanding of the disclosure. No determination has been made, and no assertion is made, as to whether any of the above might be applicable as prior art with regard to the disclosure.

SUMMARY

Embodiments of the disclosure provide an electronic device that can secure the coverage of an antenna module and can improve antenna radiation performance by partially changing the structure of a housing.

An electronic device according to various example embodiments includes: a housing having a front plate facing a first direction, a rear plate facing a second direction opposite the first direction, and a side housing surrounding a space between the front plate and the rear plate; a conductive member comprising a conductive material disposed between the front plate and the rear plate; a display viewable through the front plate; at least one antenna module including a plurality of antenna elements configured to form a beam in a third direction facing the conductive member, and disposed to be spaced apart from the conductive member in the space; and a wireless communication circuit electrically coupled to the antenna module and configured to transmit and/or receive at least one signal having a frequency in a range of 3 GHz to 100 GHz, wherein the conductive member has a first surface making a first acute angle with a virtual line crossing centers of the antenna elements in the third direction, and a second surface making a second acute angle with the virtual line, wherein a joint of the first surface and the second surface is positioned on the virtual line.

An electronic device according to various example embodiments includes: a housing having a front plate facing a first direction, a rear plate facing a second direction opposite the first direction, and a side housing surrounding a space between the front plate and the rear plate and at least partially comprising a conductive member comprising a conductive material disposed between the front plate and the rear plate; a display viewable through the front plate and including a shield layer; at least one antenna module including a plurality of antenna elements configured to form a beam in a third direction facing the conductive member and disposed to be spaced apart from the conductive member in the space; and a plurality of non-conductive members comprising a non-conductive material disposed between the conductive member and the at least one antenna module, wherein the shield layer forms a notch on the non-conductive members, the conductive member has a first surface making a first acute angle with a virtual line crossing the centers of the antenna elements in the third direction, and a second surface making a second acute angle with the virtual line, a joint of the first surface and the second surface positioned on the virtual line, and a the antenna module is configured to radiate a first signal component reflected toward the notch by the first surface or the second surface, wherein a traveling path of a second signal component is maintained.

The electronic device according to various example embodiments includes a notch is formed in the shield layer of the display and can be used as a signal window, so it is possible to decrease reduction of sensitivity for an antenna signal traveling to the display.

In the electronic device according to various embodiments, a side housing comprises a conductive member configured to reflect and/or transmit a signal radiated from the antenna module or a separate conductive member is provided, so it is possible to secure a wide coverage of the antenna module.

BRIEF DESCRIPTION OF THE DRAWINGS

The above and other aspects, features, and advantages of certain embodiments of the present disclosure will be more apparent from the following detailed description, taken in conjunction with the accompanying drawings, in which.

DETAILED DESCRIPTION

Figure 1:
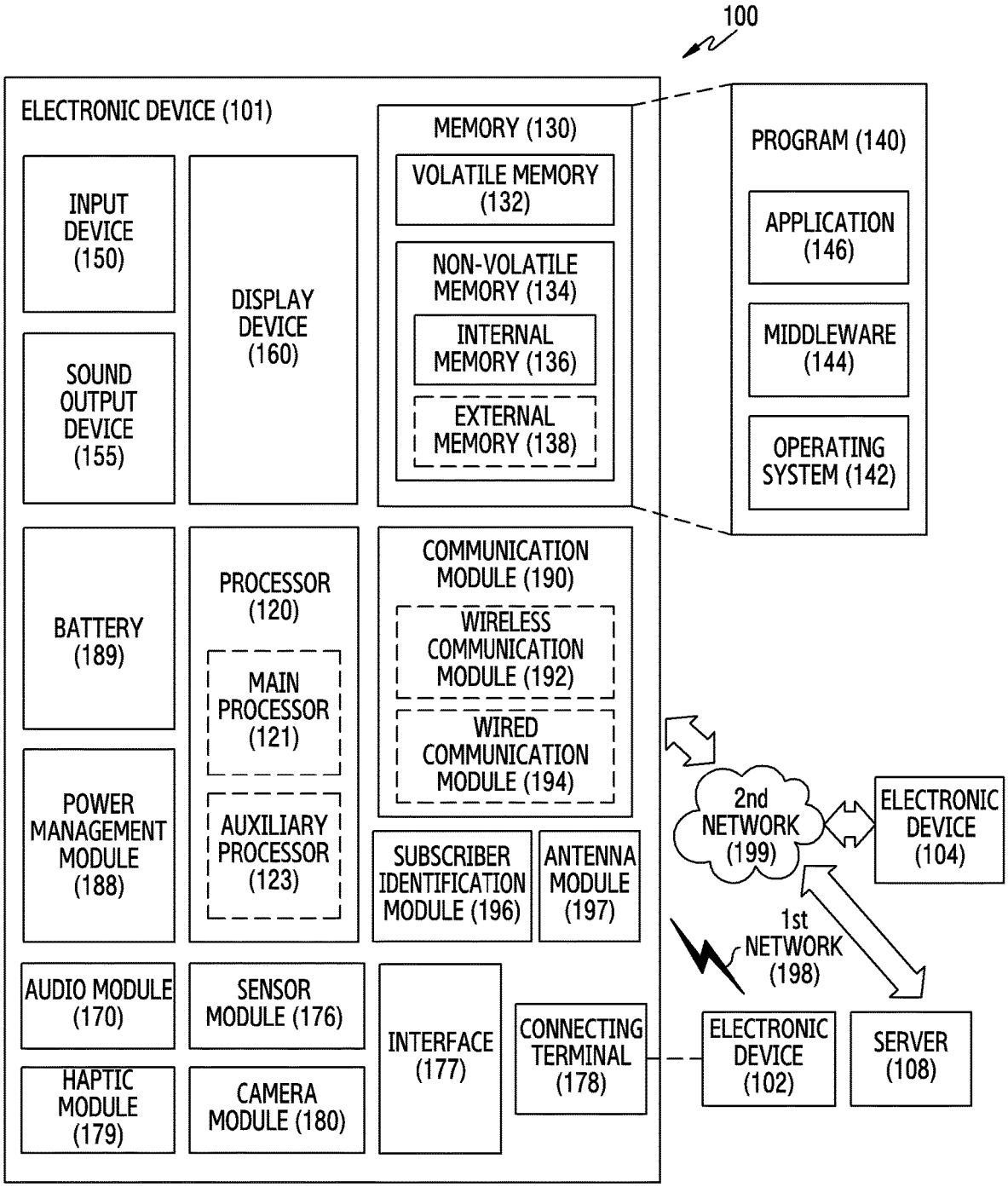
FIG. 1 is a block diagram illustrating an example electronic device in a network environment according to various embodiments.

FIG. 1 is a block diagram illustrating an example electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to an example embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to an example embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element including a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
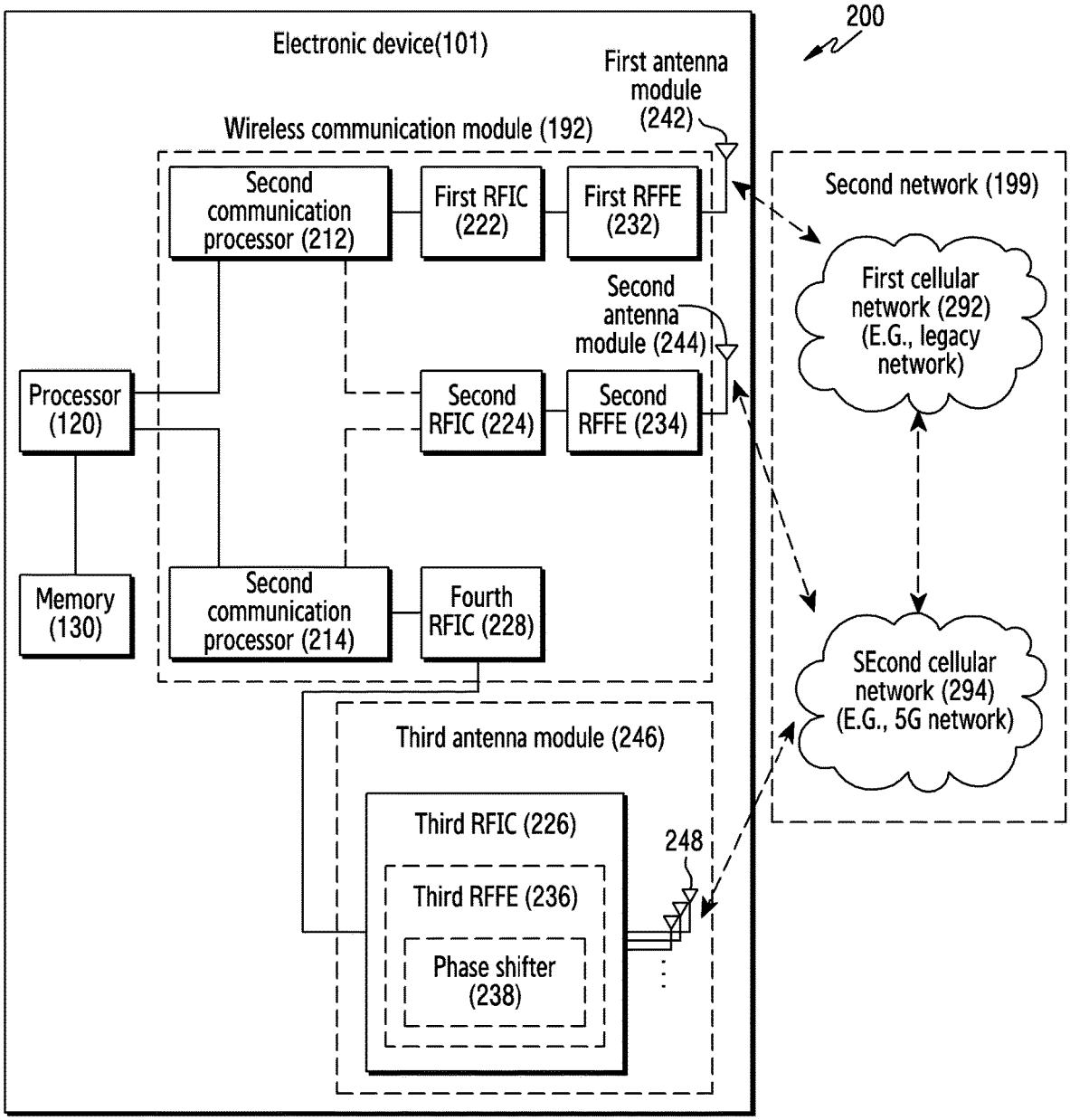
FIG. 2 is a block diagram illustrating an example electronic device in a network environment including a plurality of cellular networks according to various embodiments.

FIG. 2 is a block diagram 200 illustrating an example electronic device 101 in a network environment including a plurality of cellular networks according to various embodiments.

Referring to FIG. 2, an electronic device 101 may include a first communication processor (e.g., including processing circuitry) 212, a second communication processor (e.g., including processing circuitry) 214, a first radio frequency integrated circuit (RFIC) 222, a second RFIC 224, a third RFIC 226, a fourth RFIC 228, a first radio frequency front end (RFFE) 232, a second RFFE 234, a first antenna module 242, a second antenna module 244, and an antenna 248. The electronic device 101 may further include a processor (e.g., including processing circuitry) 120 and a memory 130. The second network 199 may include a first cellular network 292 and a second cellular network 294. According to another embodiment, the electronic device may further include at least one of the parts shown in FIG. 1 and the second network 199 may further include at least one another network. According to an embodiment, the first communication processor 212, the second communication processor 214, the first RFIC 222, the second RFIC 224, the fourth RFIC 228, the first RFFE 232, and the second RFFE 234 may form at least a portion of a wireless communication module 192. According to another embodiment, the fourth RFIC 228 may be omitted or may be included as a portion of the third RFIC 226.

The first communication processor 212 can support establishment of a communication channel with a band to be used for wireless communication with the first cellular network 292 and legacy network communication through the established communication channel. According to various embodiments, the first cellular network may be a legacy network including a 2G, 3G, 4G, or Long Term Evolution (LTE) network. The second communication processor 214 can support establishment of a communication channel corresponding to a designated band (e.g., about 6 GHz about 60 GHz) of a band to be used for wireless communication with the second cellular network 294 and 5G network communication through the established communication channel. According to various embodiments, the second cellular network 294 may be a 5G network that is defined in 3GPP. Further, according to an embodiment, the first communication processor 212 or the second communication processor 214 can support establishment of a communication channel corresponding to another designated band (e.g., about 6 GHz or less) of a band to be used for wireless communication with the second cellular network 294 and 5G network communication through the established communication channel. According to an embodiment, the first communication processor 212 and the second communication processor 214 may be implemented in a single chip or a single package. According to various embodiments, the first communication processor 212 or the second communication processor 214 may be disposed in a single chip or a single package together with the processor 120, the auxiliary processor 123, or the communication module 190. According to an embodiment, the first communication processor 212 and the second communication processor 214 is directly or indirectly connected by an interface (not shown), thereby being able to provide or receive data or control signal in one direction or two directions.

The first RFIC 222, in transmission, can converts a baseband signal generated by the first communication processor 212 into a radio frequency (RF) signal of about 700 MHz to about 3 GHz that is used for the first cellular network 292 (e.g., a legacy network). In reception, an RF signal can be obtained from the first cellular network 292 (e.g., a legacy network) through an antenna (e.g., the first antenna module 242) and can be preprocessed through an RFFE (e.g., the first RFFE 232). The first RFIC 222 can covert the preprocessed RF signal into a baseband signal so that the preprocessed RF signal can be processed by the first communication processor 212.

The second RFIC 224 can convert a baseband signal generated by the first communication processor 212 or the second communication processor 214 into an RF signal in a Sub6 band (e.g., about 6 GHz or less) (hereafter, 5G Sub6 RF signal) that is used for the second cellular network 294 (e.g., a 5G network). In reception, a 5G Sub6 RF signal can be obtained from the second cellular network 294 (e.g., a 5G network) through an antenna (e.g., the second antenna module 244) and can be preprocessed through an RFFE (e.g., the second RFFE 234). The second RFIC 224 can convert the processed 5G Sub6 RF signal into a baseband signal so that the processed 5G Sub6 RF signal can be processed by a corresponding communication processor of the first communication processor 212 or the second communication processor 214.

The third RFIC 226 can convert a baseband signal generated by the second communication processor 214 into an RF signal in a 5G Above6 band (e.g., about 6 GHz~about 60 GHz) (hereafter, 5G Above6 RF signal) that is used for the second cellular network 294 (e.g., a 5G network). In reception, a 5G Above6 RF signal can be obtained from the second cellular network 294 (e.g., a 5G network) through an antenna (e.g., the antenna 248) and can be preprocessed through the third RFFE 236. The third RFIC 226 can covert the preprocessed 5G Above6 RF signal into a baseband signal so that the preprocessed 5G Above6 RF signal can be processed by the first communication processor 214. According to an embodiment, the third RFFE 236 may be provided as a portion of the third RFIC 226.

The electronic device 101, according to an embodiment, may include a fourth RFIC 228 separately from or as at least a portion of the third RFIC 226. In this case, the fourth RFIC 228 can convert a baseband signal generated by the second communication processor 214 into an RF signal in an intermediate frequency band (e.g., about 9 GHz~about 11 GHz) (hereafter, IF signal), and then transmit the IF signal to the third RFIC 226. The third RFIC 226 can convert the IF signal into a 5G Above6 RF signal. In reception, a 5G Above6 RF signal can be received from the second cellular network 294 (e.g., a 5G network) through an antenna (e.g., the antenna 248) and can be converted into an IF signal by the third RFIC 226. The fourth RFIC 228 can covert the IF signal into a baseband signal so that IF signal can be processed by the second communication processor 214.

According to an embodiment, the first RFIC 222 and the second RFIC 224 may be implemented as at least a portion of a single chip or a single package. According to an embodiment, the first RFFE 232 and the second RFFE 234 may be implemented as at least a portion of a single chip or a single package. According to an embodiment, at least one of the first antenna module 242 or the second antenna module 244 may be omitted, or may be combined with another antenna module and can process RF signals in a plurality of bands.

According to an embodiment, the third RFIC 226 and the antenna 248 may be disposed on a substrate, thereby being able to form a third antenna module 246. For example, the wireless communication module 192 or the processor 120 may be disposed on a first substrate (e.g., a main PCB). In this case, the third RFIC 226 may be disposed in a partial area (e.g., the bottom) and the antenna 248 may be disposed in another partial area (e.g., the top) of a second substrate (e.g., a sub PCB) that is different from the first substrate, thereby being able to form the third antenna module 246. By disposing the third RFIC 226 and the antenna 248 on the same substrate, it is possible to reduce the length of the transmission line therebetween. Accordingly, it is possible to reduce a loss (e.g., attenuation) of a signal in a high-frequency band (e.g., about 6 GHz~about 60 GHz), for example, which is used for 5G network communication, due to a transmission line. Accordingly, the electronic device 101 can improve the quality and the speed of communication with the second cellular network 294 (e.g., 5G network).

According to an embodiment, the antenna 248 may be an antenna array including a plurality of antenna elements that can be used for beamforming. In this case, the third RFIC 226, for example, as a portion of the third RFFE 236, may include a plurality of phase shifters 238 corresponding to the antenna elements. In transmission, the phase shifters 238 can convert the phase of a 5G Above6 RF signal to be transmitted to the outside of the electronic device 101 (e.g., to a base station of a 5G network) through the respectively corresponding antenna elements. In reception, the phase shifters 238 can convert the phase of a 5G Above6 RF signal received from the outside through the respectively corresponding antenna element into the same or substantially the same phase. This enables transmission or reception through beamforming between the electronic device 101 and the outside.

The second cellular network 294 (e.g., a 5G network) may be operated independently from (e.g., Stand-Along (SA)) or connected and operated with (e.g., Non-Stand Along (NSA)) the first cellular network 292 (e.g., a legacy network). For example, there may be only an access network (e.g., a 5G radio access network (RAN) or a next generation RAN (NG RAN)) and there is no core network (e.g., a next generation core (NGC)) in a 5G network. In this case, the electronic device 101 can access the access network of the 5G network and then can access an external network (e.g., the internet) under control by the core network (e.g., an evolved packed core (EPC)) of the legacy network. Protocol information (e.g., LTE protocol information) for communication with a legacy network or protocol information (e.g., New Radio (NR) protocol information) for communication with a 5G network may be stored in the memory 230 and accessed by another part (e.g., the processor 120, the first communication processor 212, or the second communication processor 214).

The electronic device according to various embodiments may be one of various types of electronic devices. The electronic devices may include, for example, a portable communication device (e.g., a smartphone), a computer device, a portable multimedia device, a portable medical device, a camera, a wearable device, a home appliance, or the like. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), the element may be coupled with the other element directly (e.g., wiredly), wirelessly, or via a third element.

As used herein, the term "module" may include a unit implemented in hardware, software, or firmware, or any combination thereof, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the "non-transitory" storage medium is a tangible device, and may not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 3:
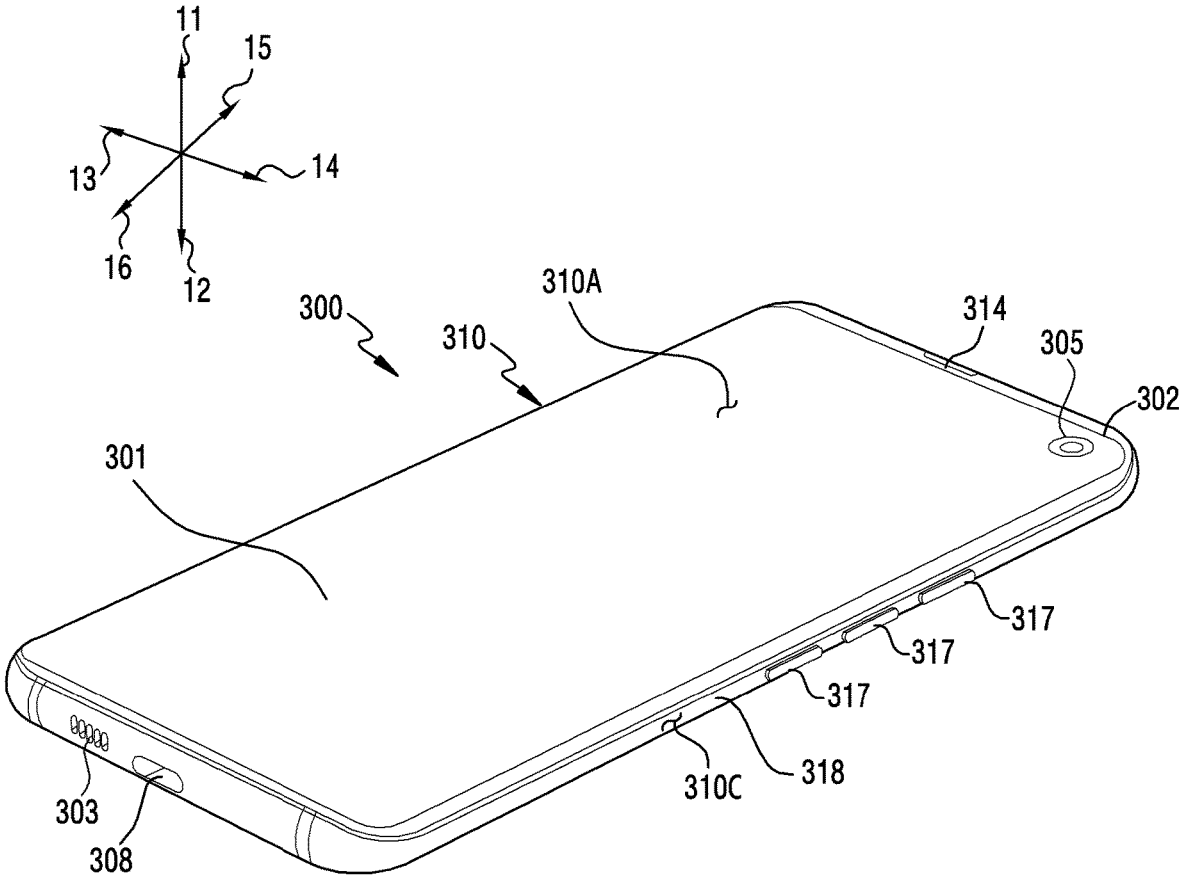
FIG. 3 is a front perspective view illustrating an example electronic device according various embodiments.
Figure 4:
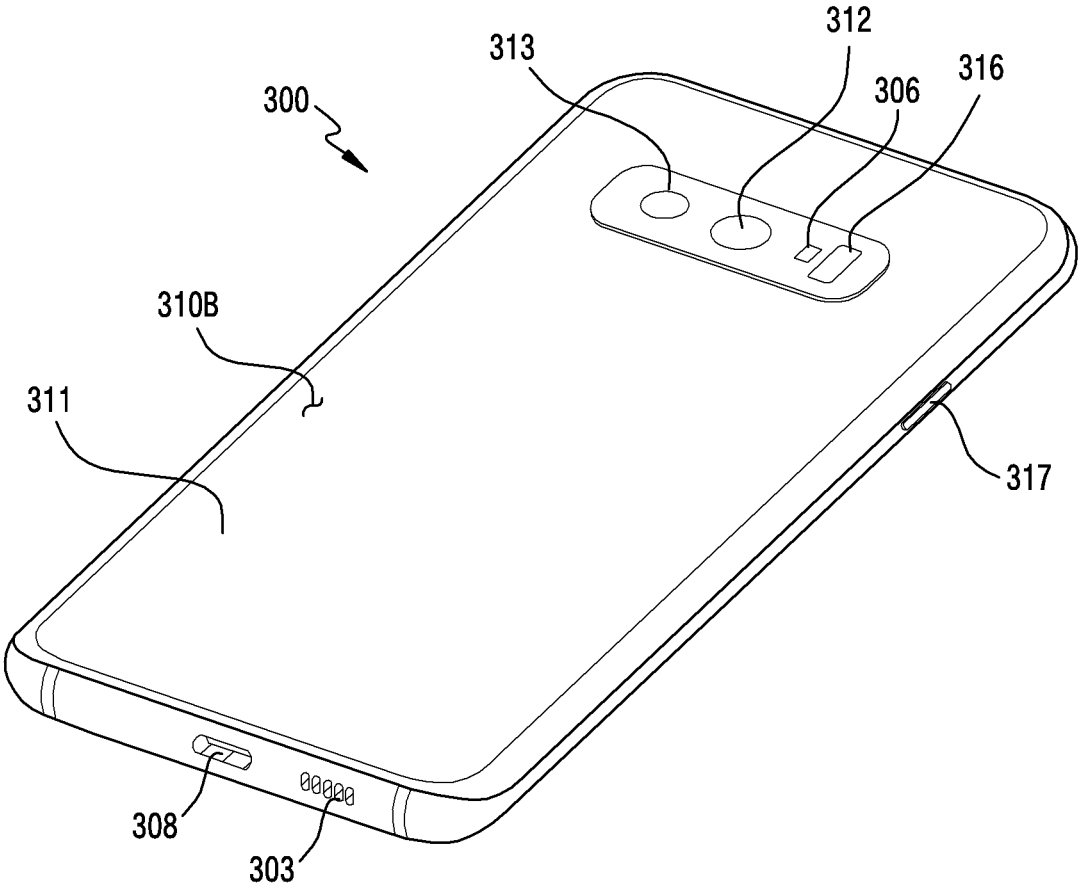
FIG. 4 is a rear perspective view illustrating the electronic device of FIG. 3 according to various embodiments.

FIG. 3 is a front perspective view illustrating an example electronic device according various embodiments, and FIG. 4 is a rear perspective view of the electronic device 300 of FIG. 3 according to various embodiments.

Referring to FIGS. 3 and 4, an electronic device 300 according to an embodiment may include: a housing 310 including a first face (or a front face) 310A, a second face (or a rear face) 310B, and a side face 310C surrounding the space between the first face 310A and the second face 310B. In another embodiment (not illustrated), the term "housing" may refer to a structure forming some of the first face 310A, the second face 310B, and the side face 310C of FIGS. 3 and 4.

According to an embodiment, at least a portion of the first face 310A may be formed of a substantially transparent front plate 302 (e.g., a glass plate or a polymer plate including various coating layers). According to embodiments, the front plate 302 may have a curved portion bending and seamlessly extending from a first surface 310A to a rear plate 311 at least at a side edge portion.

According to embodiments, the second face 310B may be formed of a substantially opaque rear plate 311. The rear plate 311 may be formed of, for example, and without limitation, coated or colored glass, ceramic, a polymer, a metal (e.g., aluminum, stainless steel (STS), or magnesium), or a combination of two or more of these materials. According to an embodiment, the rear plate 311 may have a curved portion bending and seamlessly extending from the second face 310B to the front plate 302 at least at a side edge portion.

According to various embodiments, the side 310C is combined with a front plate 302 and a rear plate 311 and may be formed by a lateral bezel structure 318 (or a "lateral member or a side wall") including metal and/or a polymer. In an embodiment, the rear plate 311 and the lateral bezel structure 318 may be integrated and may include the same material (e.g., a metallic material such as aluminum).

According to an embodiment, the electronic device 300 may include at least one of a display 301, audio modules 303 and 314, sensor modules, camera modules 305, 312, 313 and 306, key input devices 317, and connector holes 308. In some embodiments, in the electronic device 300, at least one of the components (e.g., the key input devices 317) may be omitted, or other components may be additionally included. For example, an electronic device 300 may include a sensor module not shown. For example, a sensor including a proximity sensor or an illumination sensor may be integrated with a display 301 or may be disposed adjacent to the display 301 in a region that is provided by the front plate 302. In an embodiment, the electronic device 300 may further include a light emitting element and the light emitting element may be disposed adjacent to the display 301 in the region that is provided by the front plate 302. The light emitting element, for example, may provide state information of the electronic device 300 in a light type. In another embodiment, the light emitting element, for example, may provide a light source that operates with the operation of a camera module 305. The light emitting element, for example, may include an LED, an IR LED, and a xenon lamp.

The display 301 may be exposed through, for example, a large portion of the front plate 302. In some embodiments, the edges of the display 301 may be formed to be substantially the same as the contour shape of the front plate 302 adjacent thereto. In another embodiment (not shown), the distance between the outer contour of the display 301 and the outer contour of the front plate 302 may be substantially constant in order to enlarge the exposed area of the display 301. In another embodiment (not shown), a recess or an opening may be formed in a portion of a display region of the display 301, and other electronic devices aligned with the recess or the opening such as a camera module 305 and a proximity sensor or an illumination sensor (not shown) may be included.

In another embodiment (not shown), at least one of the camera module 312 and 313, the fingerprint sensor 316, and the light-emitting element 306 may be included in the rear face of the screen display area of the display 301. In another embodiment (not shown), the display 301 may be coupled to or disposed adjacent to a touch-sensing circuit, a pressure sensor that is capable of measuring the intensity of the touch (pressure), and/or a digitizer that detects a magnetic-field-type stylus pen.

The audio modules 303 and 314 may include a microphone hole and speaker holes. The microphone hole may include a microphone disposed therein so as to acquire external sound, and in some embodiments, multiple microphones may be disposed therein so as to detect the direction of sound. In some embodiments, the speaker holes and the microphone hole may be implemented as a single hole, or a speaker may be included therein without the speaker holes (e.g., a piezo speaker). The speaker holes may include an external speaker hole and a phone call receiver hole 314.

The electronic device 300 may include a sensor modules (not shown) to generate electrical signals or data values corresponding to the internal operating state or the external environmental state of the electronic device 300. The sensor modules may include, for example, a proximity sensor disposed on the first face 310A of the housing, a fingerprint sensor integrated or adjacent to the display 301, and/or HRM sensor disposed on the second face 310B of the housing 310. The electronic device 300 may further include at least one of sensors (not shown) such as, for example, and without limitation, a gesture sensor, a gyro sensor, an atmospheric pressure sensor, a magnetic sensor, an acceleration sensor, a grip sensor, a color sensor, an infrared (IR) sensor, a biosensor, a temperature sensor, a humidity sensor, an illuminance sensor, or the like.

The camera modules 305, 312, 313, and 306 may include a first camera device 305 disposed on the first face 310A of the electronic device 300 and a second camera device 312 and 313 disposed on the second face 310B, and/or a flash 306. The camera devices 305, 312 and 313 may include one or more lenses, an image sensor, and/or an image signal processor. The flash 306 may include, for example, a light-emitting diode or a xenon lamp. In some embodiments, two or more lenses (e.g., an infrared camera lens, a wide-angle lens, and a telephoto lens) and image sensors may be disposed on one face of the electronic device 300.

The key input devices 317 may be disposed on the side faces 310C of the housing 310. In another embodiment, the electronic device 300 may not include some or all of the above-mentioned key input devices 317, and a key input device 317, which is not included therein, may be implemented in another form, such as that of a soft key or the like on the display 301. In some embodiments, the key input devices may include a sensor module 316 disposed on the second face 310B of the housing 310.

The connector holes 308 may be capable of accommodating a connector for transmitting and receiving power and/or data to and from an external electronic device, and/or a connector for transmitting and receiving an audio signal to and from an external electronic device. For example, the connector holes 308 may include USB connector or earphone jack.

Figure 5:
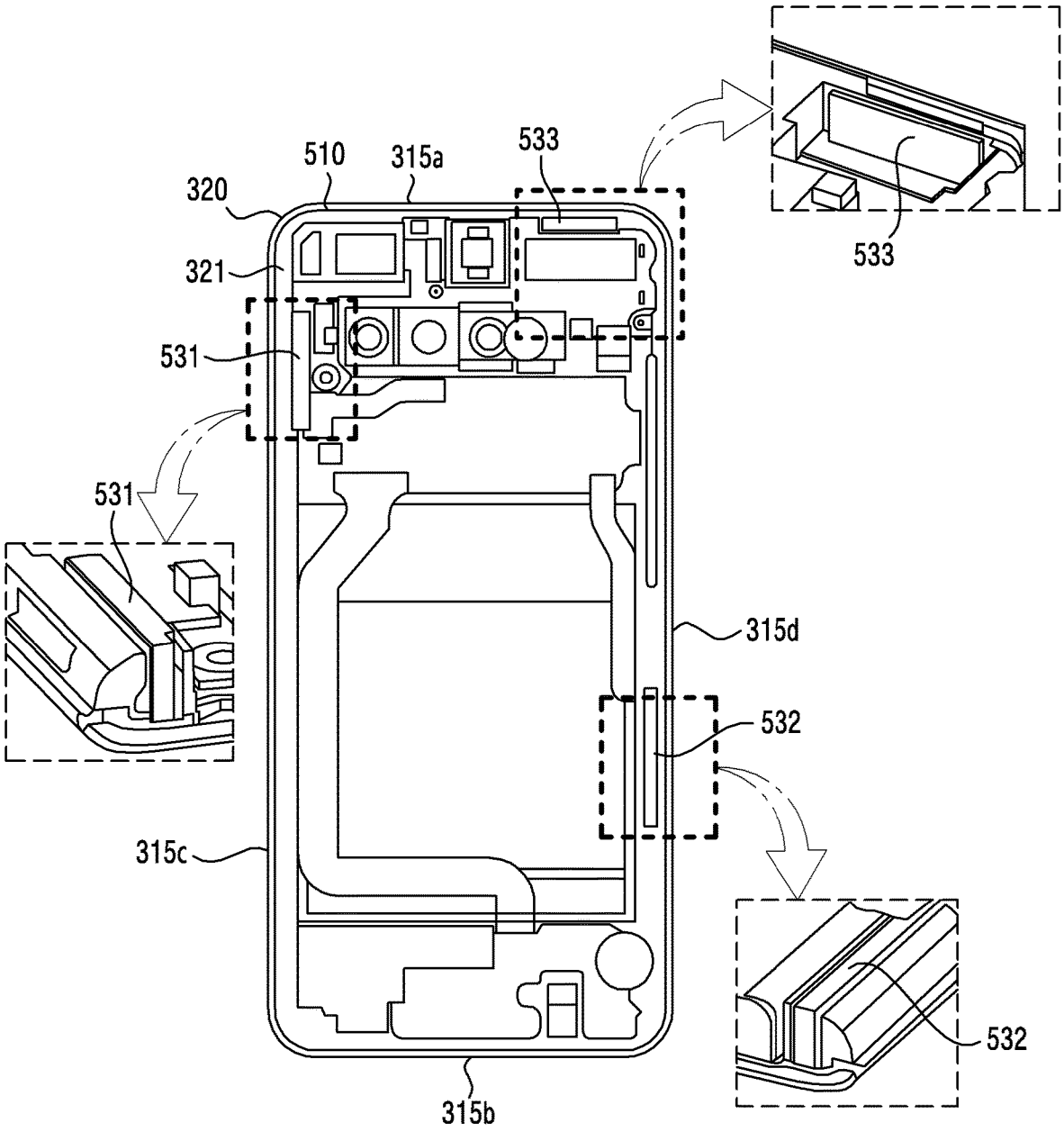
FIG. 5 is a diagram illustrating an example arrangement of an example antenna module in an electronic device according to various embodiments.

FIG. 5 is a diagram illustrating an example arrangement of an antenna module in an electronic device according to various embodiments.

Referring to FIG. 5, an electronic device 300 may include at least one of a first antenna module 531, a second antenna module 532, and a third antenna module 533. The first antenna module 531, the second antenna module 532, and/or the third antenna module 533 may be included in the internal space of a housing or a side member (e.g., side housing) 320.

According to various embodiments, the side member 320 may have a first edge 315*a*, a second edge 315*b*, a third edge 315*c*, and/or a fourth edge 315*d*. The first edge 315*a* of the side member 320 may form a portion of the side (e.g., the side 310C in FIG. 3) of the housing. For example, the first edge 315*a* may be an edge extending along the upper portion of the housing 310. The second edge 315*b* may face the first edge 315*a* and extend in parallel with the first edge 315*a*, thereby forming a portion of the housing 310 (e.g., the lower portion of the housing 310). The third edge 310*c* may extend from an end of the first edge 315*a* to an end of the second edge 315*b* and may be substantially perpendicular to the first edge 315*a* and the second edge 315*b*. The fourth edge 315*d* may extend from another end of the first edge 315*a* to another end of the second edge 315*b* in parallel with the third edge 315*c*. The first edge 315*a* and the second edge 315*b* may be shorter than the third edge 315*c* and the fourth edge 315*d*.

According to various embodiments, the first antenna module 531 and/or the second antenna module 532 may be vertically mounted in the internal space formed by the side member 320 (e.g., the internal space of the housing 310). According to various embodiments, in order to secure a space for mounting electronic parts (e.g., a battery) in the housing 210 and secure emission performance of the first antenna module 531 and the second antenna module, the wider surfaces of the first antenna module 531 and the second antenna module 532 may be disposed to face the side 310C. For example, the surfaces of the first antenna module 531 and the second antenna module 532 on which patch array antennas are formed may be disposed to face the side 310C.

According to various embodiments, the first antenna module 531 and the second antenna module 532 may be disposed at the longest edges of the side member 320. For example, the first antenna module 531 may be disposed at the third edge 315*c* of the side member 320 and the second antenna module 532 may be disposed at the fourth edge 315*d* of the side member 320. According to various embodiments, the first antenna module 531 may be disposed offset from the second antenna module 532. For example, the first antenna module 531 may be disposed at the third edge 315*c* close to the first edge 315*a* and the second antenna module 532 may be disposed at the fourth edge 315*d* close to the second edge 315*b*.

According to various embodiments, the third antenna module 533 may be disposed at a short edge of the side member. For example, the third antenna module 533 may be disposed at the first edge 315*a* of the side member 320. The third antenna module 533 may be disposed close to the corner formed by the first edge 315*a* and the fourth edge 315*d*. The side member 320 may have segmenting portion and may operate as a legacy antenna.

Figure 6:
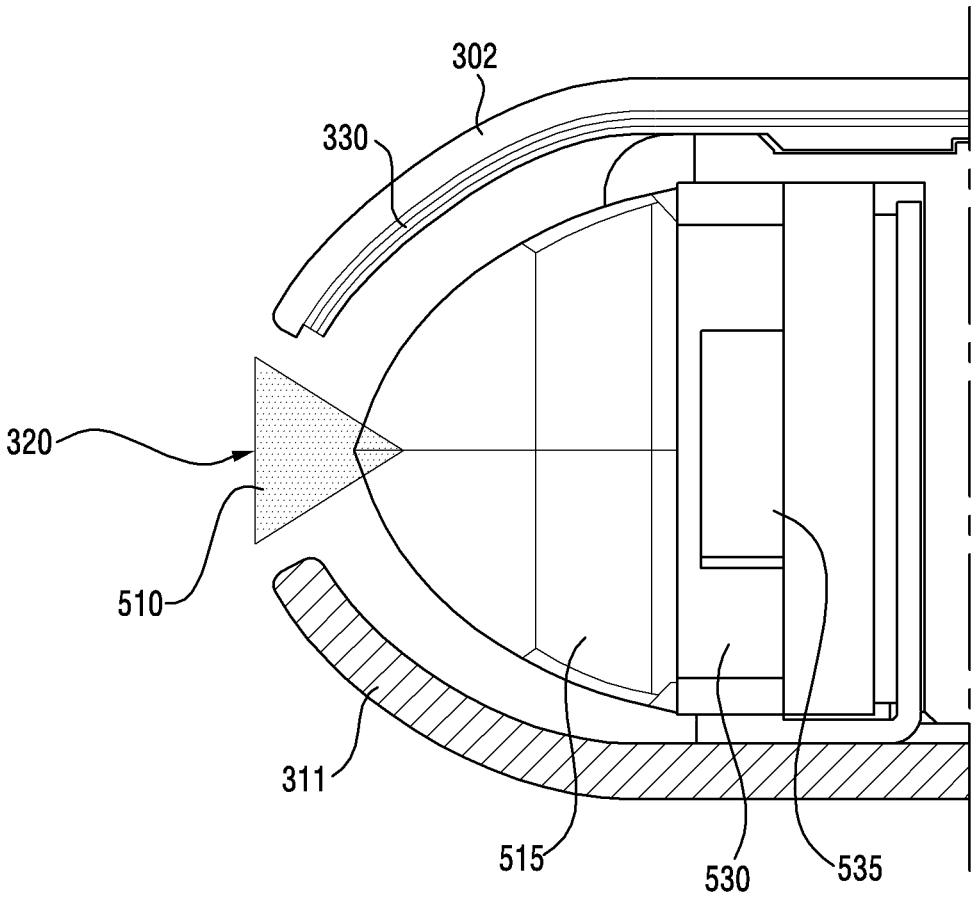
FIG. 6 cross-sectional view illustrating an example arrangement of a conductive member according to various embodiments.

FIG. 6 is a cross-sectional view illustrating an example arrangement of a conductive member according to various embodiments.

Referring to FIG. 6, the electronic device 300 may include a front plate 302, a rear plate 311, a side member (e.g., side housing) 320, and/or an antenna module 530 (e.g., the first antenna module 531, the second antenna module 532, or the third antenna module 533 shown in FIG. 5).

According to various embodiments, the front plate 302 forms a surface of the electronic device 300 and can transmit light, which is emitted from a display panel 330, to the outside. The electronic device 300 can transmit information by the light emitted from the display panel 330 through the front plate 302. The front plate 302 may include, for example, and without limitation, a transparent polymer (e.g., polyimide (PI) or polyethylene terephthalate (PET)), a glass material, or the like.

According to various embodiments, the rear plate 311 is disposed to face the front plate 302, thereby being able to form an internal space between the front plate 302 and the rear plate 311. The side member 320 may be disposed along edges of the front plate 302 and the rear plate 311. The side member 320 is disposed between the edge of the front plate 302 and the edge of the rear plate 311, thereby being able to provide a side of the electronic device 300.

According to various embodiments, the side member 320 may include a conductive member 510 and/or a non-conductive member 515. The conductive member 510 may form a side (e.g., the side 310C in FIG. 3) of the electronic device 300. A virtual line connecting the centers of the conductive member 510 and the antenna module 530 may be substantially parallel with the flat portions of the rear plate 311 and the front plate 302. The non-conductive member 515 may be disposed between the conductive member 510 and the antenna module 530. The non-conductive member 515 of the side member 320 may be formed with the conductive member 510 by double-injection molding. The non-conductive member 515 can pass a signal radiated from the antenna module 530. The conductive member 510 can reflect the signal that has passed through the non-conductive member 515. According to various embodiments, the side member 320 may be formed integrally with a supporting member 321 extending into the electronic device from the non-conductive member 515.

According to various embodiments, the antenna module 530 may be disposed adjacent to the non-conductive member 515 and may be supported by the supporting member 321. The antenna module 530 may include an antenna element 535. The antenna element 535 may be connected with a communication circuit. The communication circuit can transmit or receive at least one signal having a frequency in a range of, for example, 3 GHz to 100 GHz through the antenna element 535 to transmit/receive a mmWave signal. The electronic device 300 may include the antenna module 530 (e.g., the first antenna module 531, the second antenna module 532, or the third antenna module 533 shown in FIG. 5). The antenna module may include an array antenna for beamforming.

Figure 7A:
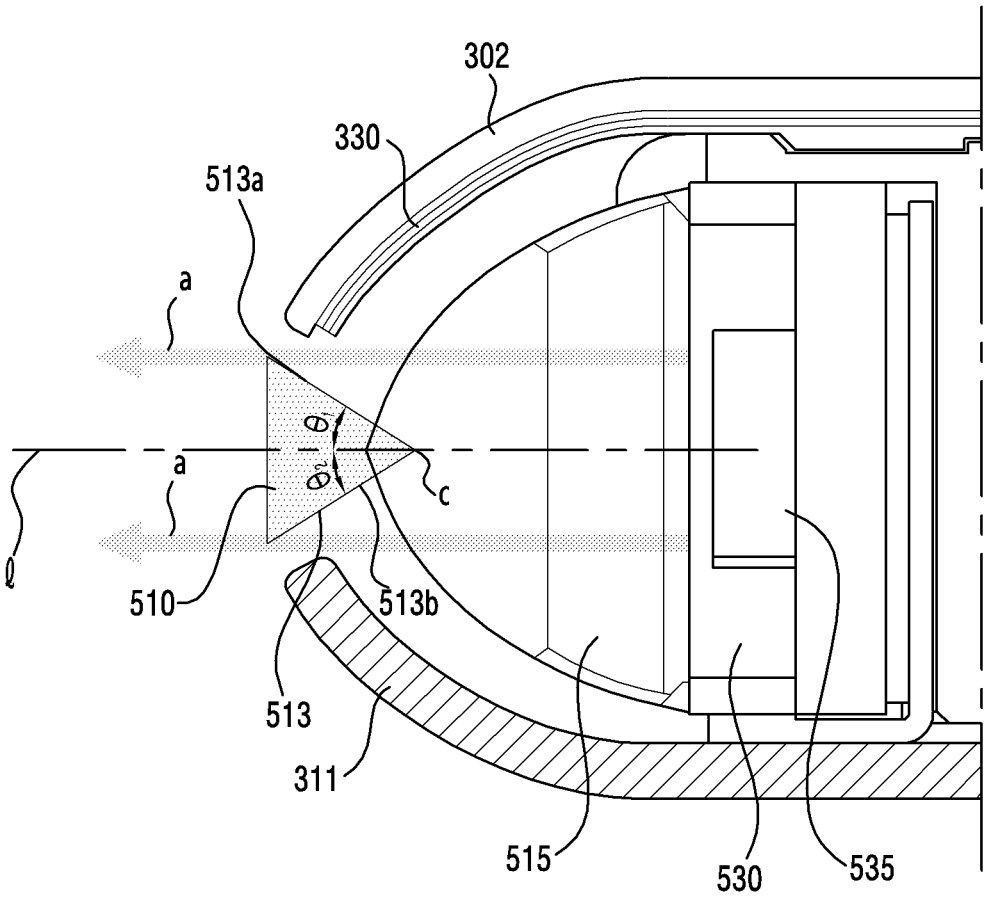
FIG. 7A is a diagram illustrating an example transmission path of a signal transmitted to a conductive member according to various embodiments.
Figure 7B:
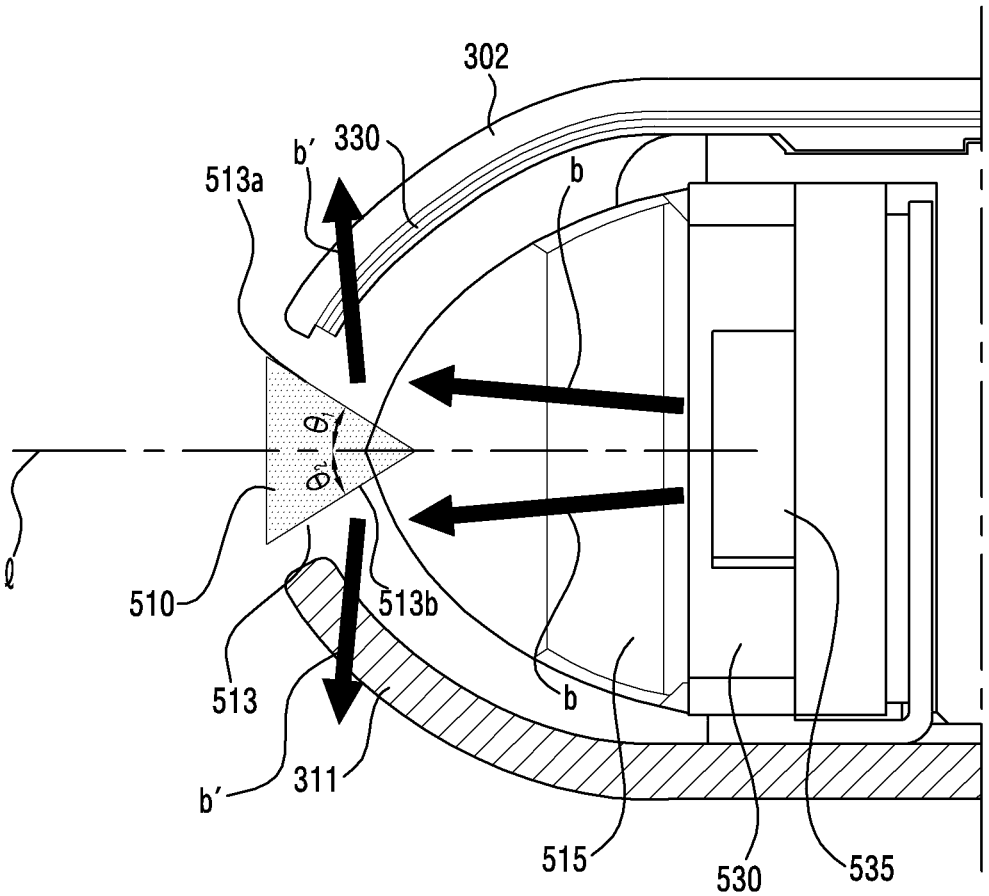
FIG. 7B is a diagram illustrating an example transmission path of a signal transmitted to a conductive member according to various embodiments.

FIG. 7A is a diagram illustrating an example transmission path of a signal transmitted to a conductive member according to various embodiments and FIG. 7B is a diagram illustrating an example transmission path of a signal transmitted to a conductive member according to various embodiments.

According to various embodiments, in the electronic device 300, it is possible to adjust the shape or the position of the conductive member 510 in order to secure the coverage of a signal that is radiated from the antenna module 530. In an embodiment, at least a portion of the conductive member 510 may be formed in a wedged shape facing the antenna module 530. The surface of the wedged shape of the conductive member 510 may have a slope toward the antenna module 530. The surface of the wedged shape of the conductive member 510 can reflect a signal. The surface of the wedged shape can operate as a reflective surface 513. The reflective surface 513 may have a first surface 513*a* making a first acute angle θ1 with a virtual line '1' crossing the center of the antenna element 535 toward the conductive member 510, and a second surface 513*b* making a second acute angle θ2 with the virtual line '1'. The joint c of the first surface 513*a* and the second surface 513*b* (e.g., the apex of the wedged shape) may be positioned on the virtual line T.

The conductive member 510 and the antenna element 535 may be disposed to face each other, and the centers of the antenna element 535 and the conductive member 510 may be aligned with each other.

Referring to FIG. 7A, a signal of a vertical partial component 'a' radiated from the antenna module 530 may diffract and pass through or may be partially reflected by the conductive member 510 of the side member 320, whereby the traveling direction of the vertical partial component 'a' can be maintained.

The signal of the vertical partial component 'a' can reach the conductive member 510 by traveling from the antenna element 535. The signal of the vertical partial component 'a' can travel to the outside after diffracting through the conductive member 510. The thickness of the conductive member 510 may be determined such that the signal of the vertical partial component 'a' can diffract through the conductive member 510. For example, the amplitude of the signal of the vertical partial component 'a' is perpendicular to the front plate 302 and the rear plate 311, so the signal can travel in the same direction after diffracting through the conductive member 510 of the reflective surface 513 of the conductive member 510.

Referring to FIG. 7B, a signal of a horizontal partial component 'a' radiated from the antenna module 530 may have high directionality toward the front plate 302 or the rear plate 311 by the conductive member 510. The inclined reflective surface 513 of the conductive member 510 can reflect the signal of the horizontal partial component b' toward the front plate 302 or the rear plate 311. The reflective signal of the horizontal partial component b' can travel through the front plate 302 or the rear plate 311.

The signal of the horizontal partial component 'b' can reach the conductive member 510 by traveling from the antenna element 535. The signal of the horizontal partial component 'b' can be reflected to the outside by the conductive member 510. The reflective surface 513 of the conductive member 510 may be formed such that the reflected signal of the horizontal partial component b' travels toward the front plate 302 or the rear plate 311. The front plate 302 or the rear plate 311 may form a propagation window that the signal of the horizontal partial component b' can pass through.

According to various embodiments, the conductive member 510 can transmit the signal of a vertical partial component 'a' of a signal transmitted from the antenna element 535, and can reflect the signal of a horizontal partial component b' to the front plate 302 or the rear plate 311. Accordingly, the electronic device including the conductive member 510 can secure the coverage of a signal that is radiated from the antenna element 535.

Figure 8:
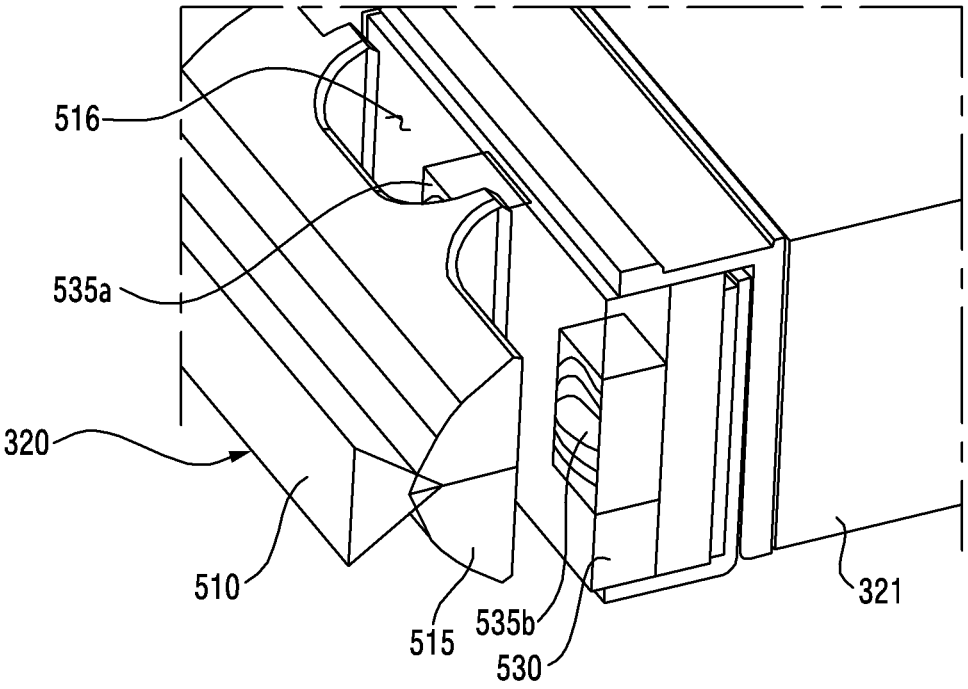
FIG. 8 is a diagram illustrating an example arrangement of an antenna module and a nonconductive member according to various embodiments.

FIG. 8 is a diagram illustrating an example arrangement of an antenna module and a non-conductive member according to various embodiments.

Referring to FIG. 8, the non-conductive member 515 may be disposed between the conductive member 510 and the antenna module 530. The antenna module 530 may include a plurality of antenna elements 535*a* and 535*b*. The antenna elements 535*a* and 535*b* may be arranged along a side.

According to various embodiments, antenna elements 535*a* and 535*b* may operate as an array antenna. The antenna elements 535*a* and 535*b* can form a beam pattern that travels toward the non-conductive member 515. In the area where the antenna elements 535*a* and 535*b* are disposed, at least one groove 516 may be formed in the non-conductive member 515. In an embodiment, the non-conductive member 515 may be formed, based on the shape of the front plate 302 or the rear plate 311. According to an embodiment, an adhesive member (e.g., an adhesive tape or an adhesive) may be disposed between the non-conductive member 515 and the front plate 302 or the rear plate 311. The adhesive member can bond the front plate 302 or the rear plate 311 to the side member 320.

According to various embodiments, the conductive member 510 may be aligned with the straight line on which the antenna elements 535*a* and 535*b* of the antenna module 530 are disposed.

According to various embodiments, the side member 320 may include the conductive member 510, the nonconductive member 515, and/or the supporting member 321. The conductive member 510, the non-conductive member 515, and/or the supporting member 321 may be integrally formed and may be formed by double-injection molding. The supporting member 321 may be made of a conductive material. The antenna module 530 may be disposed on the supporting member 321 such that the antenna elements 535*a* and 535*b* face the non-conductive member 515.

Figure 9A:
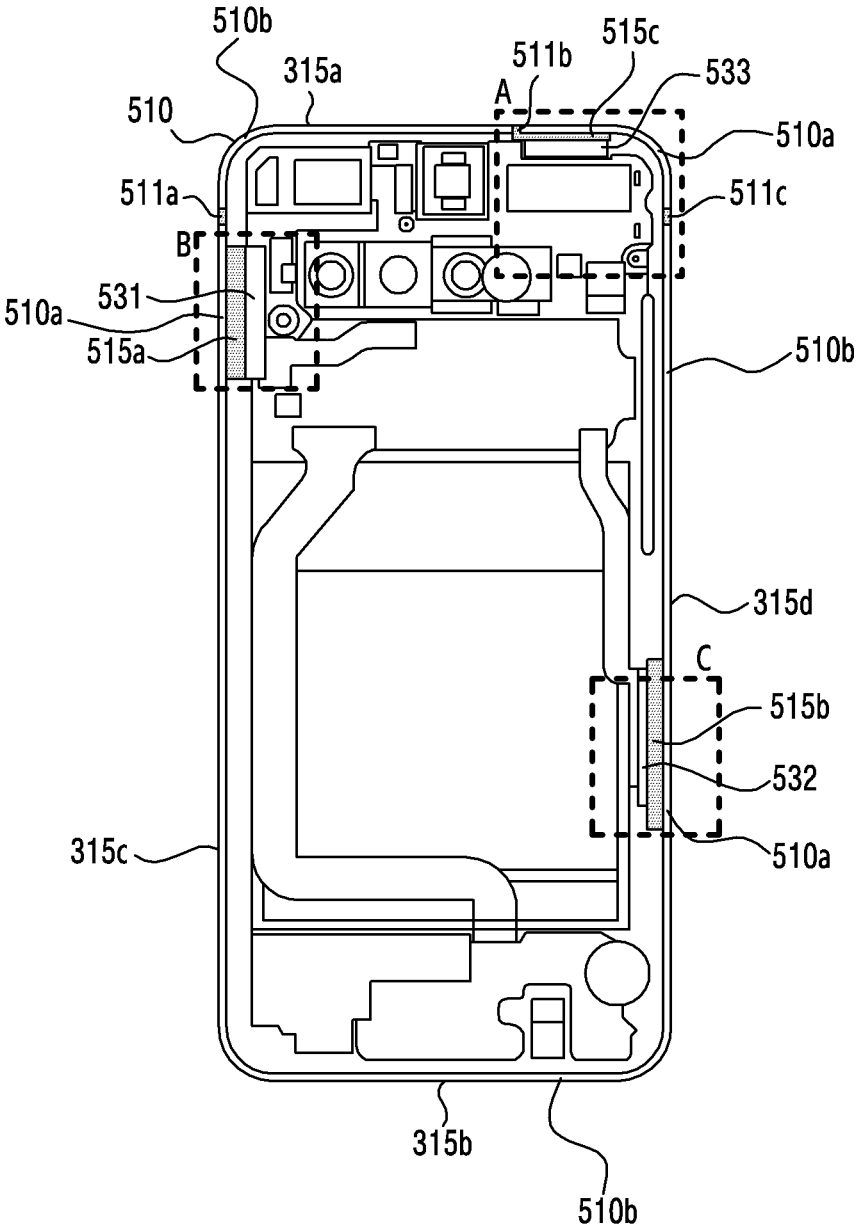
FIG. 9A is a diagram illustrating an example arrangement of a plurality of antenna modules in a housing according to various embodiments.
Figure 9B:
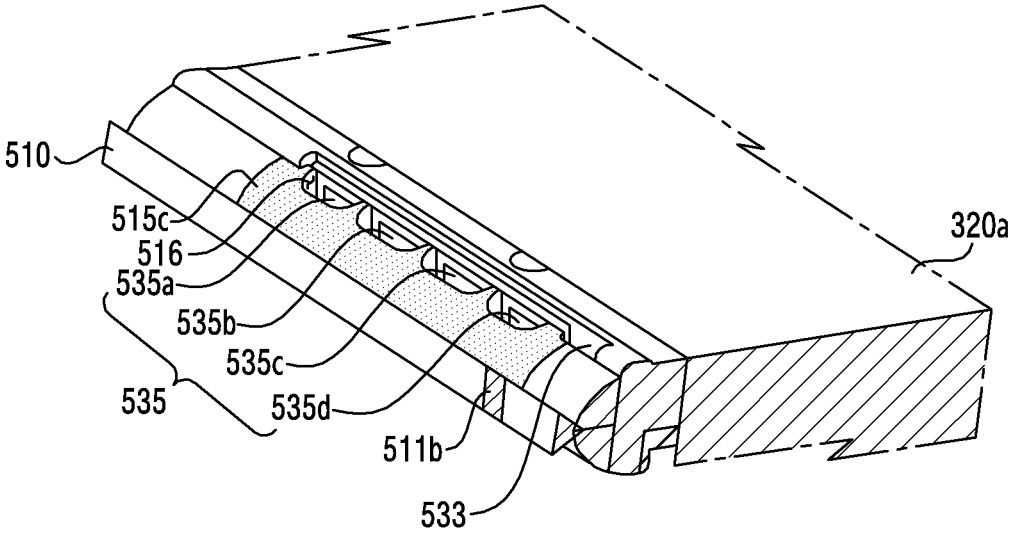
FIG. 9B is a diagram illustrating an example arrangement of a plurality of antenna modules in a housing according to various embodiments.
Figure 9C:
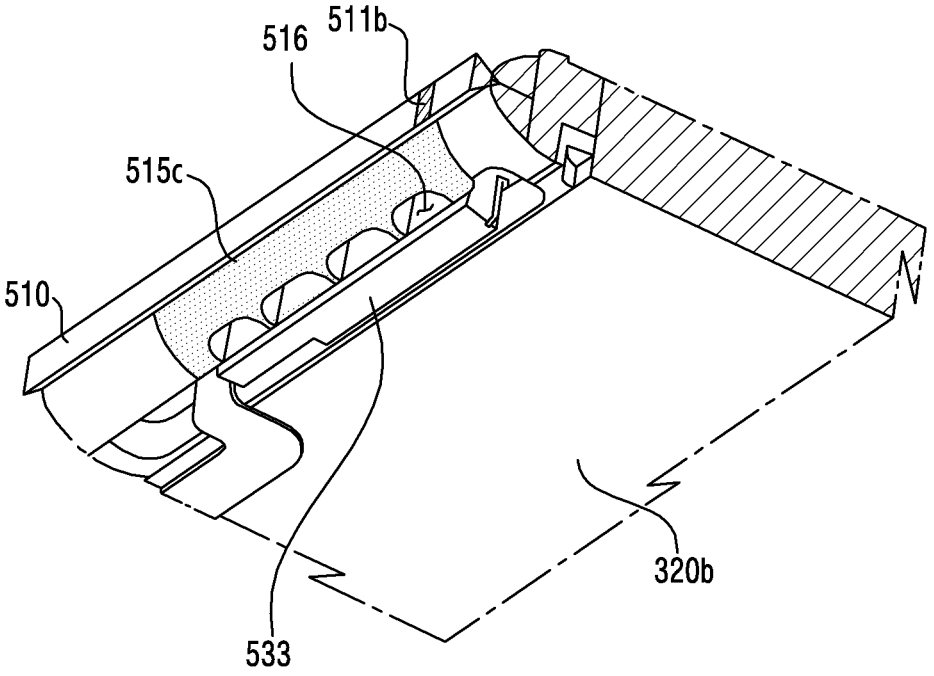
FIG. 9C is a diagram illustrating an example arrangement of a plurality of antenna modules in a housing according to various embodiments.
Figure 9D:
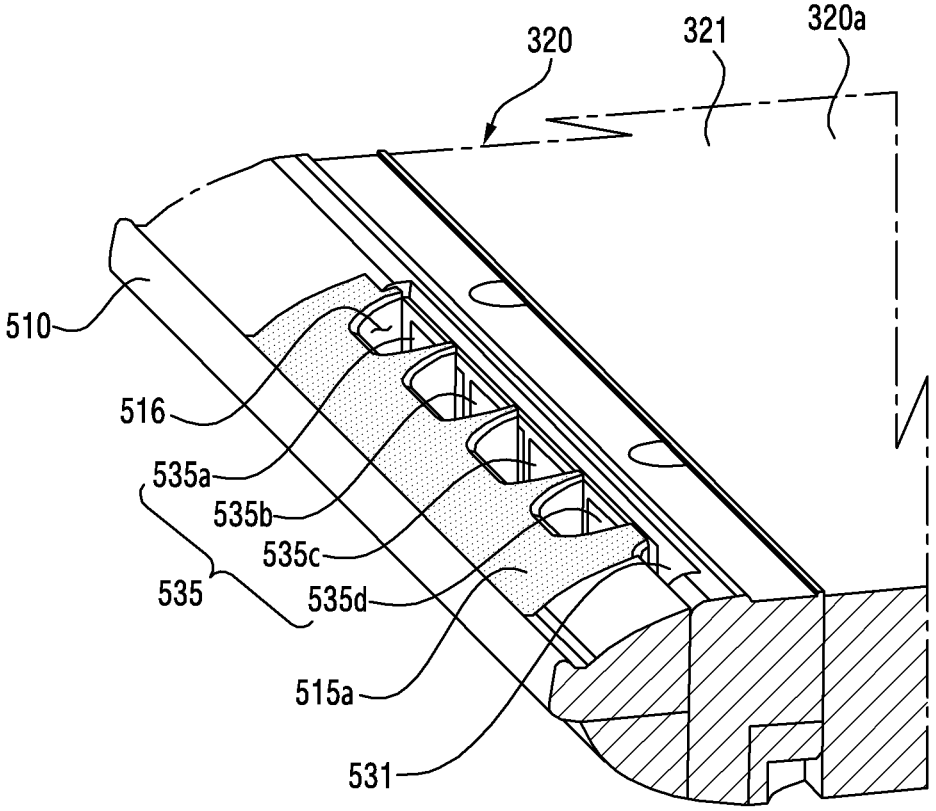
FIG. 9D is a diagram illustrating an example arrangement of a plurality of antenna modules in a housing according to various embodiments.

FIG. 9A is a diagram illustrating an example arrangement of a plurality of antenna modules in a housing according to various embodiments, FIG. 9B is a diagram illustrating an example arrangement of a plurality of antenna modules in a housing according to various embodiments, FIG. 9C is a diagram illustrating an example arrangement of a plurality of antenna modules in a housing according to various embodiments, and FIG. 9D is a diagram illustrating an example arrangement of a plurality of antenna modules in a housing according to various embodiments.

Referring to FIG. 9A, an electronic device 300 may include at least one of a first antenna module 531, a second antenna module 532, and a third antenna module 533. The first antenna module 531, the second antenna module 532, and/or the third antenna module 533 may be included in an internal space of a housing or a side member 320.

According to various embodiments, the side member 320 may have a first edge 315*a*, a second edge 315*b*, a third edge 315*c*, and a fourth edge 315*d*. The side member 320 may include a conductive member 510 exposed to the outside from the electronic device. The conductive member 510 may form a side of the electronic device. The conductive member 510 forming the first edge 315*a* of the side member 320 may form a portion of the side (e.g., the side 310C in FIG. 3) of the housing. According to various embodiments, the conductive member 510 may have second areas 510*b*, and first areas 510*a* disposed between the second areas 510*b* and disposed adjacent to the antenna modules 531, 532, and 533. The conductive members disposed in the first areas 510*a* may have wedged shapes facing the antenna modules 531, 532, and 533.

According to various embodiments, a portion of the first antenna module 531 may be in contact with a first non-conductive member 515*a*. The first non-conductive member 515*a* may be disposed between the first antenna module 531 and the conductive member 510. The first non-conductive member 515*a* may be disposed along the conductive member 510 in an area overlapping the first antenna module 531. In an embodiment, the first non-conductive member 515*a* may be disposed adjacent to the third edge 315*c* of the first antenna module 531.

According to various embodiments, a portion of the second antenna module 532 may be in contact with the second non-conductive member 515*b*. The second non-conductive member 515*b* may be disposed between the second antenna module 532 and the conductive member 510. The second non-conductive member 515*b* may be disposed along the conductive member 510 in an area overlapping the second antenna module 532. In an embodiment, the second non-conductive member 515*b* and the second antenna module 532 may be disposed adjacent to the fourth edge 315*d*.

According to various embodiments, a portion of the third antenna module 532 may be in contact with the third non-conductive member 515*c*. The third non-conductive member 515*c* may be disposed between the third antenna module 533 and the conductive member 510. The third non-conductive member 515*c* may be disposed between the third antenna module 533 and the conductive member 510. The third non-conductive member 515*c* may be disposed along the conductive member 510 in an area overlapping the third antenna module 533. In an embodiment, the third non-conductive member 515*c* and the third antenna module 533 may be disposed adjacent to the first edge 315*a*.

The first antenna module 531, the second antenna module 532, and/or the third antenna module 533 may be connected with a communication circuit. The communication circuit (e.g., the third RFIC 226 shown in FIG. 2) can transmit and/or receive signals of about 6 GHz to 100 GHz through the first antenna module 531, the second antenna module 532, and the third antenna module 533.

According to various embodiments, the side member 320 may include a conductive member 510 and a plurality of segmenting portions 511*a*, 511*b*, and 511*c*. The side member 320 may be segmented by the segmenting portions 511*a*, 511*b*, and 511*c*.

According to various embodiments, a portion of the side member 320 segmented by the first segmenting portion 511*a* and the second segmenting portion 511*b* can operate as an antenna element. The conductive member 510 segmented by the first segmenting portion 511*a* and the second segmenting portion 511*b* and/or the conductive member 510 segmented by the second segmenting portion 511*b* and the third segmenting portion 511*c* can operate as a multi-band antenna. For example, the segmented conductive member 510 can operate as a 4G network, WiFi, or Bluetooth antenna.

Referring to FIGS. 9B and 9C, a third antenna module 533 disposed in an area A shown in FIG. 9A is shown.

According to various embodiments, the third antenna module 533 may be disposed adjacent to the first edge 315*a* at which the segmenting portion 511*b* is formed on the conductive member 510. The third antenna module 533 may be disposed to face the conductive member 510. The third non-conductive member 515*c* may be disposed between the third antenna module 533 and the conductive member 510. The third antenna module 533 may include a plurality of antenna elements 535*a*, 535*b*, 535*c*, and 535*d*.

According to various embodiments, the third non-conductive member 515*c* may have grooves 516 formed toward the conductive member 510 at positions corresponding to the antenna elements 535*a*, 535*b*, 535*c*, and 535*d*. The third non-conductive member 515*c* may be disposed along the conductive member 510 at a position corresponding to the third antenna module 533. In an embodiment, the third non-conductive member 515*c* may be formed integrally with the segmenting portion 511*b*. The conductive member 510 segmented by the segmenting portion 511*b* can operate as an antenna. The third antenna module 533 can operate as an antenna having a frequency different from that of the conductive member 510 operating as an antenna. The antenna elements 535*a*, 535*b*, 535*c*, and 535*d* of the third antenna module 533 may face the conductive member 510. A signal that is radiated from the antenna element 535 can be transmitted to the conductive member 510 through the third non-conductive member 515*c*. Some of signals transmitted to the conductive member 510 may be reflected and the other may diffract and keep traveling.

Referring to FIG. 9D, the side member 320 may include a conductive member 510, a first non-conductive member 515*a*, and a supporting member 321. The first antenna module 531 may include an antenna element 535 including a plurality of antenna elements 535*a*, 535*b*, 535*c*, and 535*d*. The first antenna module 531 may be disposed between the first non-conductive member 515*a* and the supporting member 321. The first non-conductive member 515*a* may have grooves 516 corresponding to the antenna elements 535*a*, 535*b*, 535*c*, and 535*d*. The first non-conductive member 515*a* may be disposed along the conductive member 510 at a position corresponding to the first antenna module 531.

According to various embodiments, the second non-conductive member 515*b* and the second antenna module 532 may have configurations that are the same as or similar to those of the first non-conductive member 515*a* and the first antenna module 531.

Figure 10A:
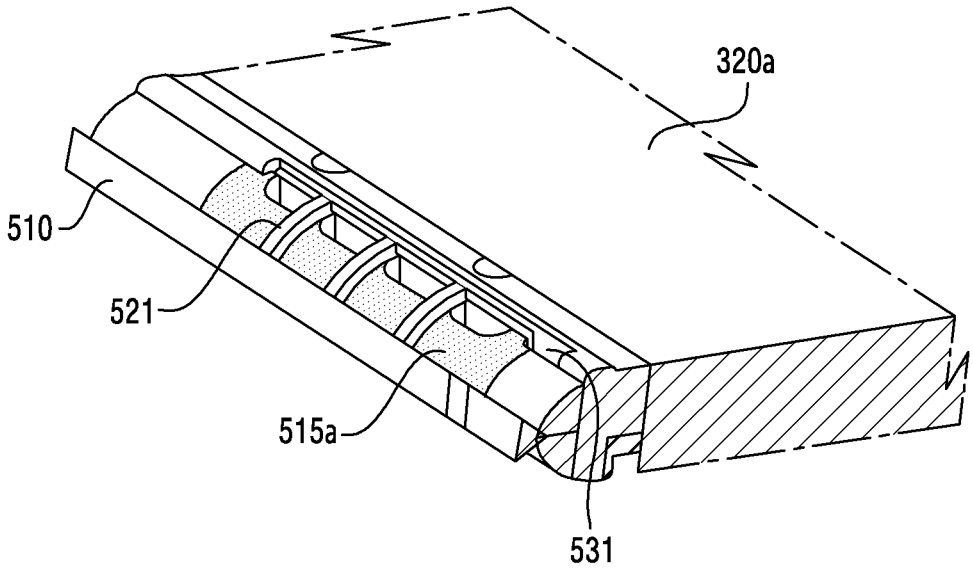
FIG. 10A is a diagram illustrating an example rib surrounding a nonconductive member according to various embodiments.
Figure 10B:
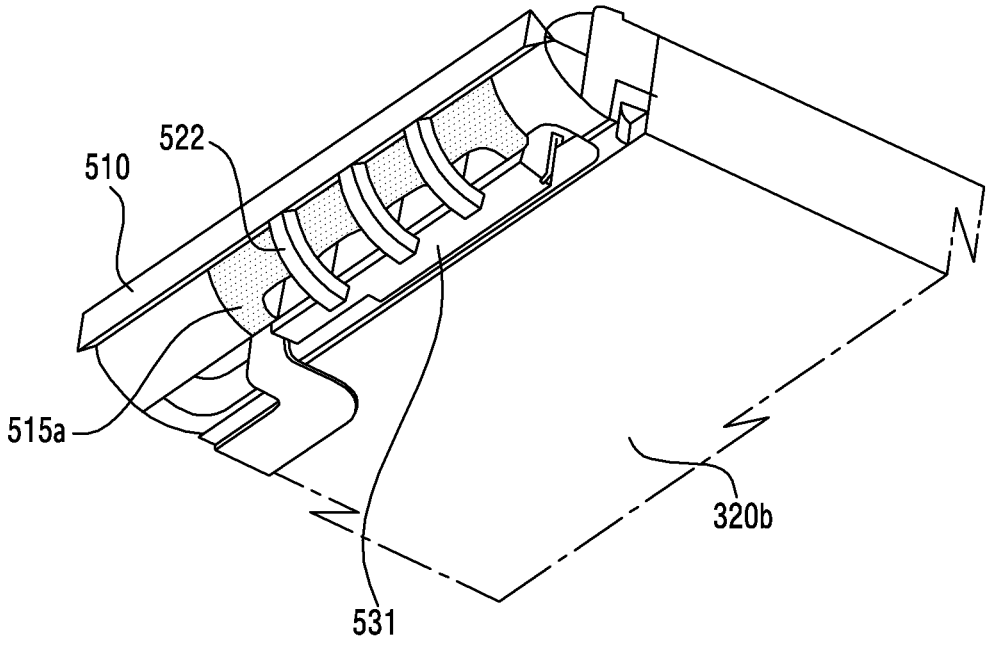
FIG. 10B is a diagram illustrating an example rib surrounding a nonconductive member according to various embodiments.

FIG. 10A is a diagram illustrating an example rib surrounding a nonconductive member according to various embodiments and FIG. 10B is a diagram illustrating an example rib surrounding a nonconductive member according to various embodiments.

Referring to FIGS. 10A and 10B, the first antenna module 531 may be disposed to face the first non-conductive member 515*a* and the conductive member 510. The first antenna module 531 may be disposed along a first conductive member.

According to various embodiments, the first non-conductive member 515*a* may be surrounded by an upper rib 521 extending from the top 320*a* of the side member to the conductive member 510. A plurality of upper ribs 521 may be provided and may be disposed at positions where they do not interfere with signals of antenna elements. For example, the first antenna module 531 may include a plurality of antenna elements (e.g., the antenna elements 535*a*, 535*b*, 535*c*, and 535*d* shown in FIG. 9D). Gaps may be defined between the antenna elements 535*a*, 535*b*, 535*c*, and 535*d*, and a plurality of upper ribs 521 may be disposed between the antenna elements 535*a*, 535*b*, 535*c*, and 535*d*.

According to various embodiments, the first non-conductive member 515*a* may be surrounded and supported by a lower rib 522 extending from the bottom 320*b* of the side member to the conductive member 510. A plurality of lower ribs 522 may be provided and may be formed at positions where they do not interfere with signals of the antenna elements 535*a*, 535*b*, 535*c*, and 535*d*. A plurality of lower ribs 522 may be disposed between the antenna elements 535*a*, 535*b*, 535*c*, and 535*d*.

According to various embodiments, the second non-conductive member 515*b* and the third non-conductive member 515*c* may also be surrounded and supported by the upper rib 521 and the lower rib 522. According to various embodiments, the upper rib 521 and the lower rib 522 can increase the strength of the side member 320. The upper rib 521 and the lower rib 522 may be made of a metal material. The upper rib 521 and the lower rib 522 can protect the antenna module from an external force and can support the antenna module.

Figure 11A:
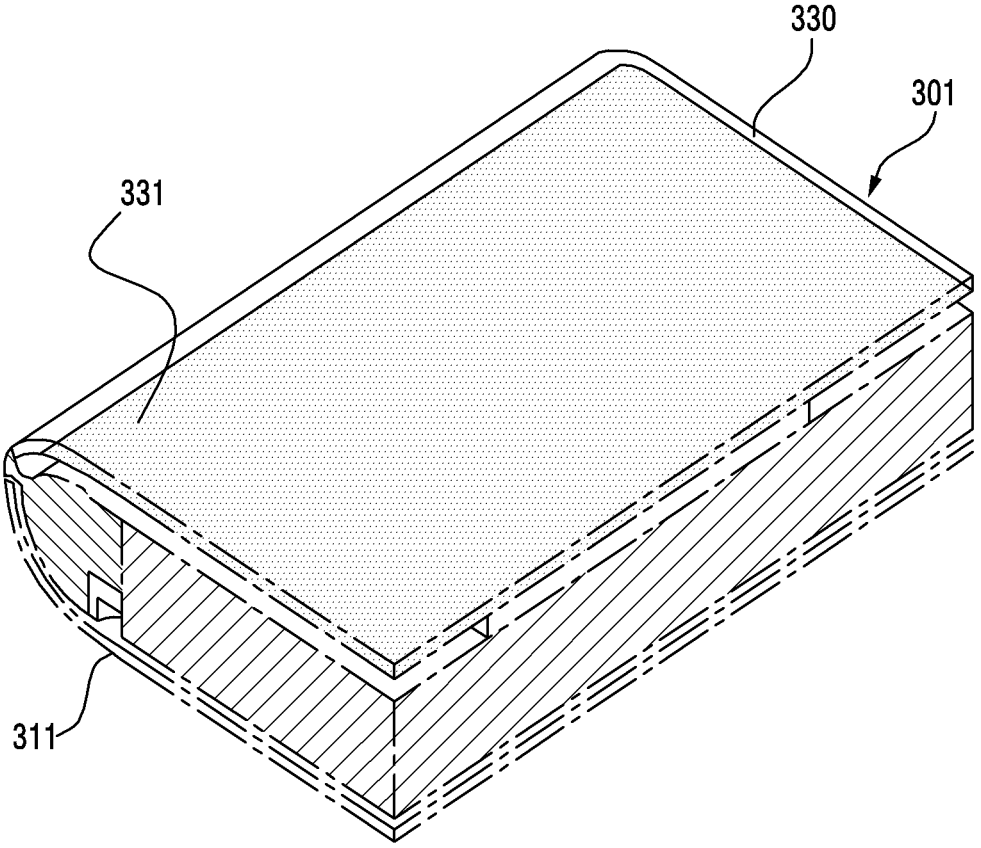
FIG. 11A is a diagram illustrating an example notch formed in a display shield layer according to various embodiments.
Figure 11B:
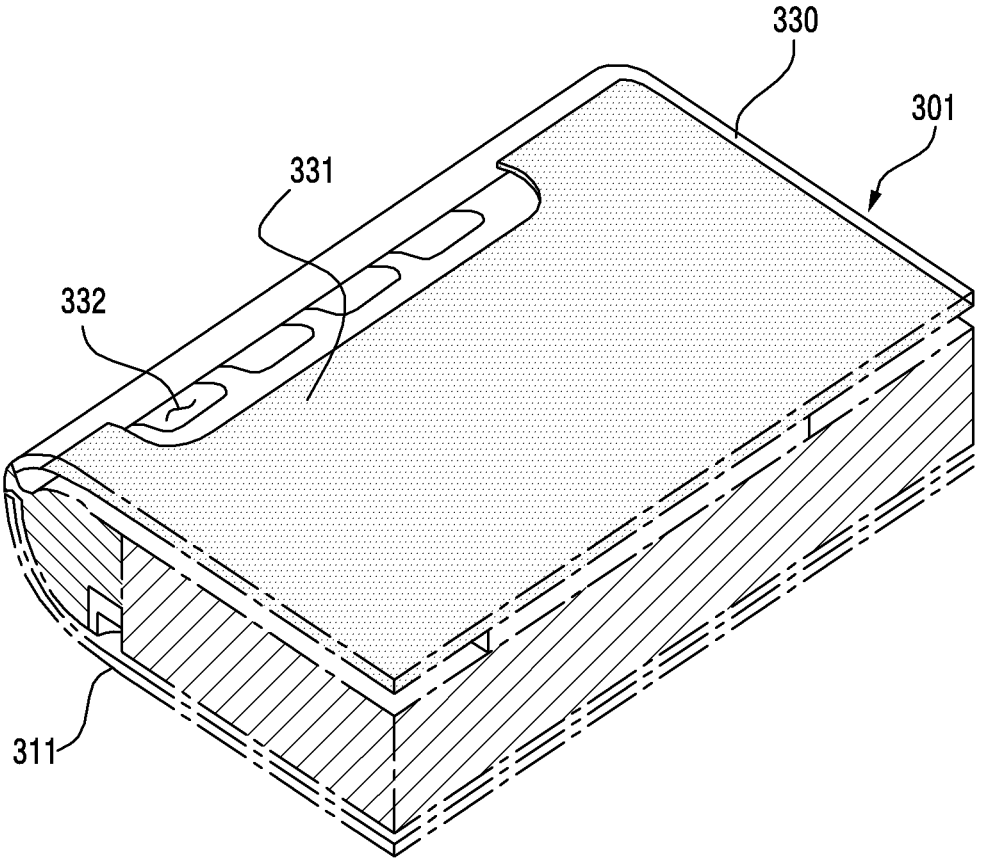
FIG. 11B is a diagram illustrating an example notch formed in a display shield layer according to various embodiments.
Figure 11C:
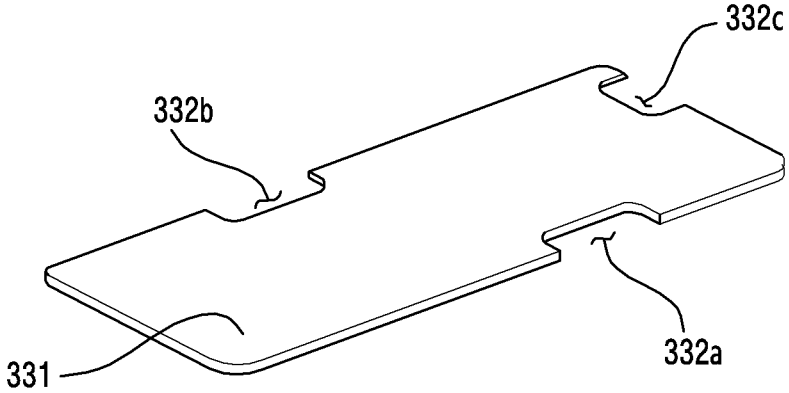
FIG. 11C is a diagram illustrating an example notch formed in a display shield layer according to various embodiments.

FIG. 11A is a diagram illustrating an example notch formed in a display shield layer according to various embodiments, FIG. 11B is a diagram illustrating an example notch formed in a display shield layer according to various embodiments, and FIG. 11C is a diagram illustrating an example notch formed in a display shield layer according to various embodiments.

FIG. 11A shows the shape of a display panel 330 in an area in which an antenna module is not disposed, FIG. 11B shows the shape of the display panel 330 in which an antenna module is disposed, and FIG. 11C shows a shield layer of the display panel 330.

Referring to FIGS. 11A, 11B, and 11C, in an area in which an antenna module is not disposed, the display panel 330 may be disposed along the front of the electronic device 300 to face the rear plate. In an area in which an antenna module (e.g., the first antenna module 531 shown in FIG. 9A), a notch 332 may be formed in a shield layer 331 included in the display panel 330. The shield layer 331 may be a conductive plate (e.g., a copper plate) and may interfere with a signal that is radiated from an antenna module. The notch formed in the shield 331 can operate as a signal window.

According to various embodiments, in the area in which an antenna module is disposed, the shield layer 331 can transmit a signal, which is radiated from an antenna module, toward the display panel 330 because it has the notch 332.

Referring to FIG. 11C, the shield layer may include multiple notches, including, for example, a first notch 332*a*, a second notch 332*b*, and/or a third notch 332*c* at a position where an antenna module is formed. According to various embodiments, the first notch 332*a* may be formed in an area corresponding to a first antenna module (e.g., the first antenna module 531 shown in FIG. 9A). The second notch 332*b* may be formed in an area corresponding to a second antenna module (e.g., the second antenna module 532 shown in FIG. 9A). The third notch 332*c* may be formed in an area corresponding to a third antenna module (e.g., the third antenna module 533 shown in FIG. 9A).

Figure 12:
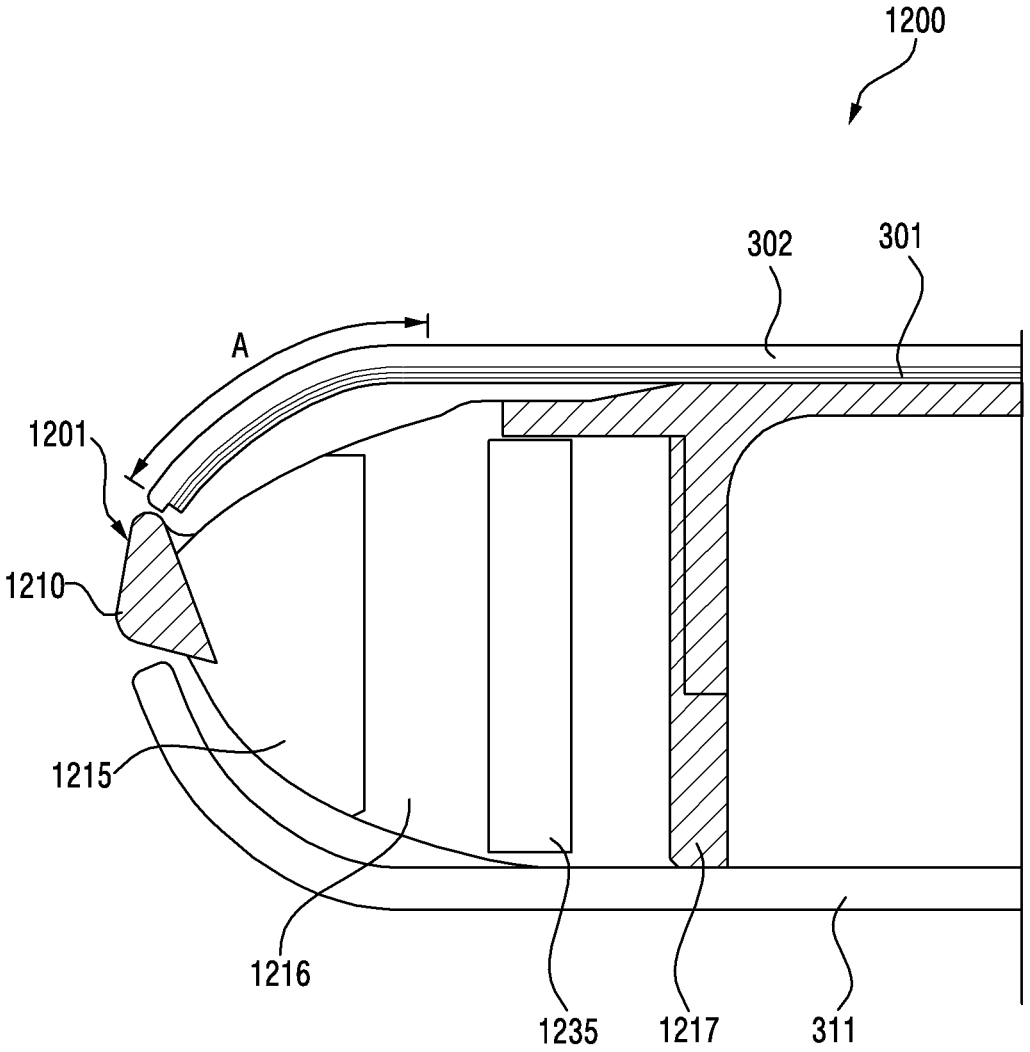
FIG. 12 is a cross-sectional view illustrating an example arrangement of a conductive member according to various embodiments.
Figure 13:
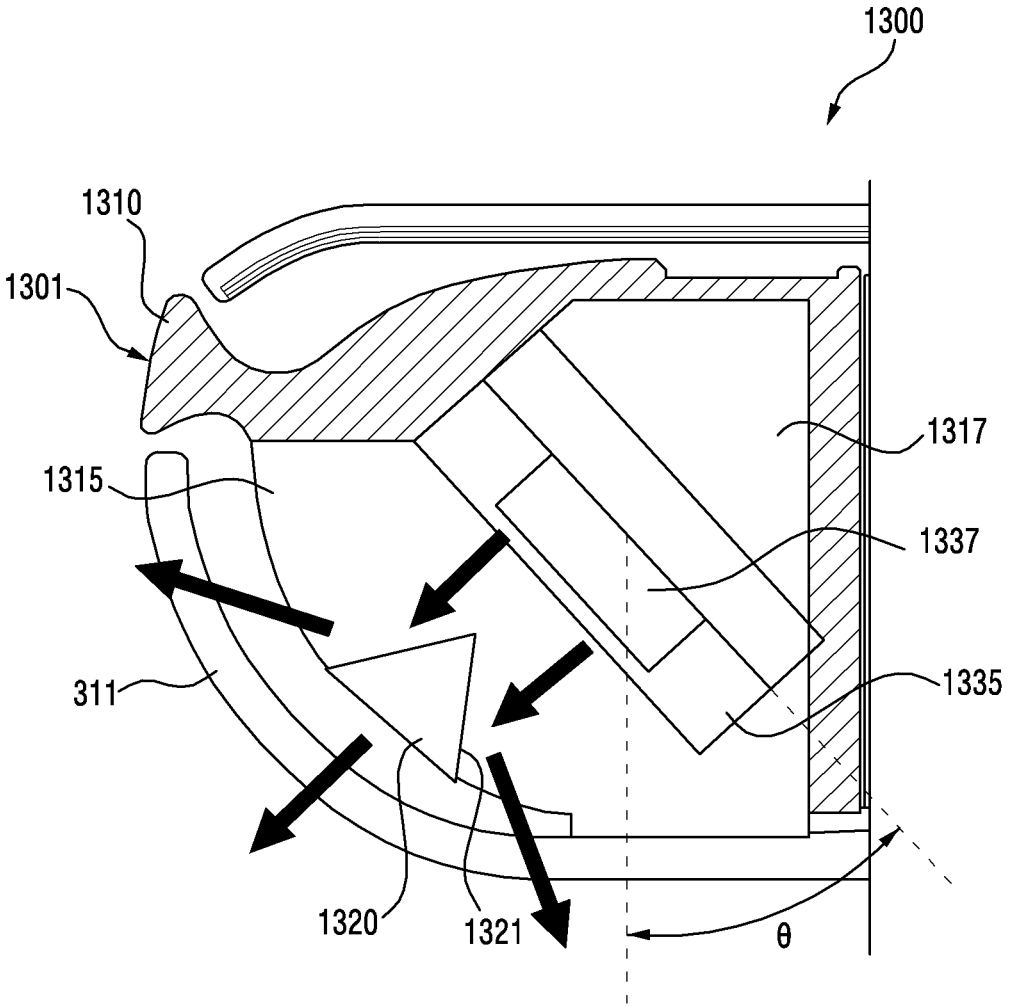
FIG. 13 is a cross-sectional view illustrating an example arrangement of a conductive member according to various embodiments.

FIG. 12 is a diagram illustrating an example arrangement of a conductive member according to various embodiments and FIG. 13 is a diagram illustrating an example arrangement of a conductive member according to various embodiments.

Referring to FIG. 12, the electronic device 1200 may include a display 301, a side member 1201, and/or a rear plate 311.

According to various embodiments, the display 301 is disposed under the front plate 302 and can transmit information to a user through the front plate. The display 301 may include a display panel (e.g., the display panel 330 shown in FIG. 11B) or a shield layer (e.g., the shield layer 331 shown in FIG. 11B). The display panel may be disposed under the front plate 302. The shield layer may be disposed under the display panel.

According to various embodiments, the side member 1201 may include a conductive member 1210, a nonconductive member 1215, and/or the supporting member 1217. The conductive member 1210 may form a side of the electronic device 1200. The nonconductive member 1215 may be in contact with the conductive member 1210 and may be formed by double-injection molding. The nonconductive member 1215 may have a space in which an antenna module 1235 is disposed, and may have a groove or an empty space 1216 in an area facing an antenna element of the antenna module 1235. The conductive member 1210 and the nonconductive member 1215 may be formed by double-injection molding. The supporting member 1217 may include a metal material.

According to various embodiment, the conductive member 1210 may not be aligned with the center of the antenna module 1235. For example, the conductive member 1210 may be disposed biased toward the front plate 302. According to various embodiments, a shield layer (e.g., 331 in FIG. 11B) of the display panel 330 may be removed in an area A in which a signal radiated from the antenna element travels toward the display 301. For example, the shield layer (e.g., 331 in FIG. 11B) may have a notch in the area A. The area A may be a signal window. According to various embodiments, the length of the area A may be a half of the wavelength $\lambda$ of a signal.

According to various embodiments, the apex of the wedged shape of the cross-section of the conductive member 1210 may not face the center of the antenna module 1235. Since the conductive member 1210 is biased toward the display 301, it is possible to change the shape of the conductive member 1210 to secure the coverage facing the side of the antenna module 1235.

According to various embodiments, the conductive member 1210 is disposed biased toward the front plate 302, whereby an aesthetic effect can be provided. Further, it may be possible to adjust the reflective direction of a signal traveling from the antenna module 1235 by disposing the conductive member 1210 such that the apex of the wedged surface of the conductive member 1210 does not coincide with the center of the antenna module 1235. In the electronic device 1200, a signal can also travel toward the display 301 by removing the shield layer (e.g., 331 in FIG. 11B).

Accordingly, the electronic device 1200 can secure the lateral coverage of the antenna module 1235.

Referring to FIG. 13, the electronic device 1300 may include a side member 1301 and a rear plate 311. The side member 1301 may include a protrusion 1310 forming a side, a conductive member 1320 reflecting or passing a signal radiated from an antenna element 1337, and a non-conductive member 1315 transmitting a signal.

The antenna module 1335 may be disposed at an angle θ from a line perpendicular to a flat area of the rear plate 311. A supporting portion 1317 having a predetermined angle may be provided to support the inclined antenna module 1335. According to various embodiments, the antenna module 1335 may be disposed to face the rear plate 311 at a designated angle. According to various embodiments, a reflective surface 1321 may be formed on a wedged surface of the conductive member 1320. A signal of a horizontal partial component of a signal radiated from the antenna element 1337 can be reflected by the reflective surface 1321 toward the side or the rear plate 311. A signal of a vertical partial component of a signal radiated from the antenna element 1337 can maintain the traveling direction by diffracting through the conductive member 1320.

According to various embodiments, the conductive member 1320 is inclined at a predetermined angle θ from a line perpendicular to the flat area of the rear plate 311, whereby the antenna element 1337 can radiate signals in all direction to the rear plate 311 except for the display direction.

According to various embodiments, by disposing the conductive member 1320, it is possible to secure the coverage of the antenna element 1337 and improve traveling of signals of a vertical partial component and a horizontal partial component.

An electronic device (e.g., the electronic device 300 shown in FIG. 3) according to various example embodiments includes: a housing (e.g., the housing 310 shown in FIG. 3) having a front plate (e.g., the front plate 302 shown in FIGS. 3 and 6) facing a first direction (e.g., 11 in FIG. 3), a rear plate (e.g., the rear plate 311 shown in FIGS. 4 and 6) facing a second direction opposite the first direction, and a side housing (e.g., the side member 320 shown in FIGS. 5 and 6) surrounding a space between the front plate and the rear plate; a conductive member (e.g., the conductive member 510 shown in FIG. 6) comprising a conductive material disposed between the front plate and the rear plate; a display (e.g., the display 301 shown in FIG. 3) viewable through at least a portion of the front plate; at least one antenna module (e.g., the antenna module 530 shown in FIG. 6) including a plurality of antenna elements (e.g., the antenna elements 535*a* and 535*b* shown in FIG. 8) configured to form a beam in a third direction facing the conductive member, and disposed to be spaced apart from the conductive member in the space; and a wireless communication circuit electrically coupled to the antenna module and configured to transmit and/or receive at least one signal having a frequency in a range of 3 GHz to 100 GHz, wherein the conductive member may have a first surface (e.g., the first surface 513*a* shown in FIG. 7A) making a first acute angle (e.g., the first acute angle θ1 shown in FIG. 7A) with a virtual line (e.g., the virtual line '1' shown in FIG. 7A) crossing at least some of the antenna elements in the third direction, and a second surface (e.g., the second surface 531*b* shown in FIG. 7A) making a second acute angle (e.g., the second acute angle θ2 shown in FIG. 7A) with the virtual line, wherein a joint (c in FIG. 7A) of the first surface and the second surface may be positioned on the virtual line.

According to an example embodiment, the electronic device may further include a non-conductive member (e.g., the non-conductive member 515 shown in FIG. 6) comprising a non-conductive material disposed between the conductive member (e.g., the conductive member 510 shown in FIG. 6) and the antenna module (e.g., the antenna module 530 shown in FIG. 6).

According to an example embodiment, the side member (e.g., the side member 320 shown in FIG. 5) may include a plurality of ribs (e.g., the upper rib 521 shown in FIG. 10A and the lower rib 522 shown in FIG. 10B) not overlapping the antenna elements when viewed in the third direction, and disposed to face the antenna module from the conductive member.

According to an example embodiment, the ribs (e.g., upper rib 521 shown in FIG. 10A and the lower rib 522 shown in FIG. 10B) may be disposed on a surface facing the front plate or the rear plate of the non-conductive member.

According to an example embodiment, the antenna elements may define an antenna array and may be disposed along the conductive member.

According to an example embodiment, the conductive member may be parallel with a virtual center line connecting the antenna array.

According to an example embodiment, the conductive member may have a wedge shape (e.g., the shape of the conductive member 510 shown in FIG. 7A) facing the space from the side.

According to an embodiment, the side housing may include a plurality of segmenting portions (e.g., the segmenting portions 511*a*, 511*b*, and 511*c* shown in FIG. 9A) segmenting the conductive member, and a portion of the side member and the segmenting portions may be configured to operate as a portion of an antenna.

According to an example embodiment, the at least one antenna module may further include a first antenna module (e.g., the third antenna module 533 shown in FIG. 9A) disposed to face the conductive member segmented by the segmenting portions.

According to an example embodiment, the non-conductive member (e.g., the third non-conductive member 515*c* shown in FIG. 9A) may be connected with the segmenting portions (e.g., the segmenting portion 511*b* shown in FIG. 9A).

According to an example embodiment, the first antenna module (e.g., the third antenna module 533 shown in FIG. 9A) may be disposed at one (the first edge 315*a* shown in FIG. 9A) of edges of the side housing of the electronic device, and the at least one antenna module may include a second antenna module (e.g., the first antenna module 531 shown in FIG. 9A) and a third antenna module (e.g., the first antenna module 532 shown in FIG. 9A) respectively disposed at edges (e.g., the third and fourth edges 315*c* and 315*d* shown in FIG. 9A) substantially vertically extending from both ends of one of the edges.

The display may include a shield layer (e.g., the shield layer 331 shown in FIG. 11B) having a notch (e.g., the notch 332 shown in FIG. 11B) provided at a position corresponding to the at least one antenna module.

An electronic device (e.g., the electronic device 300 shown in FIG. 3) according to various example embodiments includes: a housing (e.g., the housing 310 shown in FIG. 3) having a front plate (e.g., the front plate 302 shown in FIGS. 3 and 12) facing a first direction (e.g., 11 in FIG. 3), a rear plate (e.g., the rear plate 311 shown in FIGS. 4 and 12) facing a second direction (e.g., 12 in FIG. 3) opposite the first direction, and a side housing (e.g., the side member 1201 shown in FIG. 12 and the side member 1301 shown in FIG. 13) surrounding a space between the front plate and the rear plate and at least partially comprising a conductive member comprising a conductive material disposed between the front plate and the rear plate (e.g., the conductive member 1210 shown in FIG. 12 and the conductive member 1320 shown in FIG. 13); a display (e.g., the display 301 shown in FIGS. 3 and 12) viewable through at least a portion of the front plate and including a shield layer (e.g., the shield layer 331 shown in FIGS. 11A, 11B, and 11C); at least one antenna module (e.g., the antenna module 1235 shown in FIG. 12) including a plurality of antenna elements (e.g., the antenna elements 1337 shown in FIG. 13) configured to form a beam in a third direction facing the conductive member, and disposed to be spaced apart from the conductive member in the space; and a plurality of non-conductive members (e.g., the non-conductive member 1215 shown in FIG. 12 and the non-conductive member 1315 shown in FIG. 13) disposed between the conductive member and the at least one antenna module, wherein the shield layer includes a notch (e.g., the notch 332 shown in FIG. 11B) on the non-conductive members, the conductive member has a first surface making a first acute angle with a virtual line crossing the centers of the antenna elements in the third direction, and a second surface making a second acute angle with the virtual line, a joint of the first surface and the second surface positioned on the virtual line, and the antenna module is configured to radiate a first signal component reflected toward the notch by the first surface or the second surface and a traveling path of a second signal component is maintained (see traveling paths of signal components shown in FIG. 13).

According to an example embodiment, a portion of the reflected first signal may pass through the non-conductive members and the notch, and another portion of the reflected first signal may pass through the non-conductive member and the rear plate.

According to an example embodiment, the conductive member may have a wedged shape (e.g., the shape of the conductive member 510 shown in FIG. 7A) facing the space from the side.

According to an example embodiment, the conductive member may be segmented by segmenting portions (e.g., the segmenting portions 511*a*, 511*b*, and 511*c* shown in FIG. 9A) comprising a portion of the side.

According to an example embodiment, the electronic device may further include a first antenna module (e.g., the third antenna module 533 shown in FIG. 9A) disposed to face the segmented conductive member, in which a portion of the conductive member segmented by the segmenting portion may be configured to operate as an antenna.

According to an example embodiment, one (e.g., the third non-conductive member 515*c* shown in FIG. 9A) of the non-conductive members may be connected with the segmenting portions (e.g., the segmenting portion 511*b* shown in FIG. 9A).

According to an example embodiment, the first antenna module may be disposed at one (e.g., the first edge 315*a* shown in FIG. 9A) of the sides of the electronic devices, and the antenna modules may include a second antenna module (e.g., the first antenna module 531 shown in FIG. 9A) and a third antenna module (e.g., the first antenna module 532 shown in FIG. 9A) respectively disposed at sides (e.g., the third and fourth edges 315*c* and 315*d* shown in FIG. 9A) substantially vertically extending from both ends of the side.

According to an example embodiment, the electronic device may further include a wireless communication module comprising wireless communication circuitry electrically coupled to the antenna module and configured to transmit and/or receive at least one signal having a frequency in a range of 3 GHz to 100 GHz.

In the above-described example embodiments of the disclosure, an element included in the disclosure is expressed in the singular or the plural according to presented detailed embodiments. However, the singular form or plural form is selected appropriately to the presented situation for the convenience of description, and the disclosure is not limited by elements expressed in the singular or the plural. Therefore, either an element expressed in the plural may also include a single element or an element expressed in the singular may also include multiple elements.

While the disclosure has been illustrated and described with reference to various example embodiments thereof, it will be understood that the various example embodiments are intended to be illustrative, not limiting. It will further be understood by one of ordinary skill in the art that various changes in form and detail may be made without departing from the true spirit and full scope of the disclosure, including the appended claims and equivalents thereof.

What is claimed is:

1. An electronic device comprising:

a housing having a front plate facing a first direction, a rear plate facing a second direction opposite the first direction, and a side housing surrounding a space between the front plate and the rear plate;

a conductive member comprising a conductive material disposed between the front plate and the rear plate;

a display viewable through at least a portion of the front plate;

at least one antenna module including a plurality of antenna elements configured to form a beam in a third direction facing the conductive member, and disposed to be spaced apart from the conductive member in the space; and a wireless communication circuit electrically coupled to the at least one antenna module and configured to transmit or receive at least one signal having a frequency in a range of 3 GHz to 100 GHz, wherein the conductive member has a first surface forming a first acute angle with a virtual line crossing at least portion of the antenna elements and facing the third direction, and a second surface forming a second acute angle with the virtual line, wherein a joint of the first surface and the second surface is positioned on the virtual line.

2. The electronic device of claim 1, further comprising a non-conductive member comprising a non-conductive material disposed between the conductive member and the antenna module.

3. The electronic device of claim 2, wherein the side housing includes a plurality of ribs not overlapping the antenna elements when viewed from the third direction, and disposed to face the antenna module from the conductive member.

4. The electronic device of claim 3, wherein the ribs are disposed on a surface facing the front plate or the rear plate of the non-conductive member.

5. The electronic device of claim 2, wherein the side housing includes a plurality of segmenting portions that segment the conductive member, and wherein a portion of the side housing and the segmenting portions are configured to operate as a portion of an antenna.

6. The electronic device of claim 5, wherein the at least one antenna module includes a first antenna module disposed to face the conductive member segmented by the segmenting portions.

7. The electronic device of claim 6, wherein the non-conductive member is connected with the segmenting portions.

8. The electronic device of claim 6, wherein the first antenna module is disposed at one of edges of the side housing of the electronic device, and the at least one antenna module includes a second antenna module and a third antenna module respectively disposed at edges substantially vertically extending from both ends of one of the edges.

9. The electronic device of claim 1, wherein the antenna elements define an antenna array and are disposed along the conductive member.

10. The electronic device of claim 9, wherein the conductive member is parallel with a virtual center line connecting the antenna array.

11. The electronic device of claim 1, wherein the conductive member has a wedge shape facing the space from the side housing.

12. The electronic device of claim 1, wherein the display includes a shield layer having a notch provided at a position corresponding to the at least one antenna module.

13. An electronic device comprising:

a housing having a front plate facing a first direction, a rear plate facing a second direction opposite the first direction, and a side housing surrounding a space between the front plate and the rear plate and at least partially comprising a conductive member comprising a conductive material disposed between the front plate and the rear plate;

a display viewable through at least a portion of the front plate and including a shield layer;

at least one antenna module including a plurality of antenna elements configured to form a beam in a third direction facing the conductive member, and disposed to be spaced apart from the conductive member in the space; and a plurality of non-conductive members comprising a non-conductive material disposed between the conductive member and the at least one antenna module, wherein the shield layer includes a notch on the non-conductive members, the conductive member including a first surface forming a first acute angle with a virtual line crossing the centers of the antenna elements and facing in the third direction, and a second surface forming a second acute angle with the virtual line, a joint of the first surface and the second surface is positioned on the virtual line, and wherein the at least one antenna module is configured to radiate a first signal component and a second signal component, the first signal component reflected toward the notch by the first surface or the second surface, wherein a traveling path of the second signal component is maintained.

14. The electronic device of claim 13, wherein a portion of the reflected first signal passes through the non-conductive members and the notch, and another of the reflected first signal passes through the non-conductive member and the rear plate.

15. The electronic device of claim 13, wherein the conductive member has a wedge shape facing the space from the side.

16. The electronic device of claim 13, wherein the conductive member is segmented by segmenting portions forming a portion of the side housing.

17. The electronic device of claim 16, further comprising a first antenna module disposed to face the segmented conductive member, wherein a portion of the conductive member segmented by the segmenting portion is configured to operate as an antenna.

18. The electronic device of claim 17, wherein one of the non-conductive members is connected with the segmenting portions.

19. The electronic device of claim 17, wherein the first antenna module is disposed at one side of the electronic device, and the antenna module includes a second antenna module and a third antenna module respectively disposed at sides substantially vertically extending from both ends of the one side.

20. The electronic device of claim 13, further comprising a wireless communication module electrically coupled to the antenna module and configured to transmit or receive at least one signal having a frequency in a range of 3 GHz to 100 GHz.

* * * * *